US006662782B2

(12) United States Patent
Iida et al.

(10) Patent No.: US 6,662,782 B2
(45) Date of Patent: Dec. 16, 2003

(54) CONTROLLER FOR INTERNAL COMBUSTION ENGINE

(75) Inventors: Hisashi Iida, Kariya (JP); Jun Hasegawa, Kariya (JP); Yoshiyuki Okamoto, Kariya (JP); Tomoaki Nakano, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/195,305

(22) Filed: Jul. 16, 2002

(65) Prior Publication Data

US 2003/0010317 A1 Jan. 16, 2003

(30) Foreign Application Priority Data

Jul. 16, 2001 (JP) ..... 2001-215821
Jul. 31, 2001 (JP) ..... 2001-232531

(51) Int. Cl.[7] ..... F02P 5/00
(52) U.S. Cl. ..... 123/406.47; 123/436
(58) Field of Search ..... 123/406.47, 436, 123/406.45, 406.11, 434

(56) References Cited

U.S. PATENT DOCUMENTS 5,345,911 A 9/1994 Kadowaki et al.
5,474,045 A * 12/1995 Demizu et al. ..... 123/406.47
6,155,232 A * 12/2000 Shibagaki ..... 123/436

FOREIGN PATENT DOCUMENTS

JP 2-238147 9/1990
JP 2000-45831 2/2000

* cited by examiner

*Primary Examiner*—Bibhu Mohanty
(74) *Attorney, Agent, or Firm*—Nixon & Vanderhye P.C.

(57) ABSTRACT

The present invention is directed to provide a controller for an internal combustion engine, capable of suppressing deterioration in drivability of an engine. A controller for an internal combustion engine has lean control means for calculating a torque margin from a reference engine speed and an actual engine speed and setting a combustion air-fuel ratio of an internal combustion engine to the lean side on the basis of the torque margin. In addition to correction of a fuel injection amount by the lean control means, the fuel injection amount is further corrected on the basis of a final correction value for reducing deterioration in drivability. The final correction value is set by selecting either a correction value which is set on the basis of an engine speed fluctuation amount or a final correction value of last time, which suppresses deterioration in drivability more. Thus, the operation of setting the air-fuel ratio to the lean side while considering deterioration in drivability can be performed.

12 Claims, 17 Drawing Sheets

| ΔNe | leanI | leanP |
|---|---|---|
| ⋮ | ⋮ | ⋮ |
| +20 | $leanI_{20}$ | $leanP_{20}$ |
| +10 | $leanI_{10}$ | $leanP_{10}$ |
| 0 | $leanI_{0}$ | $leanP_{0}$ |
| −10 | $leanI_{-10}$ | $leanP_{-10}$ |
| ⋮ | ⋮ | ⋮ |

FIG. 24
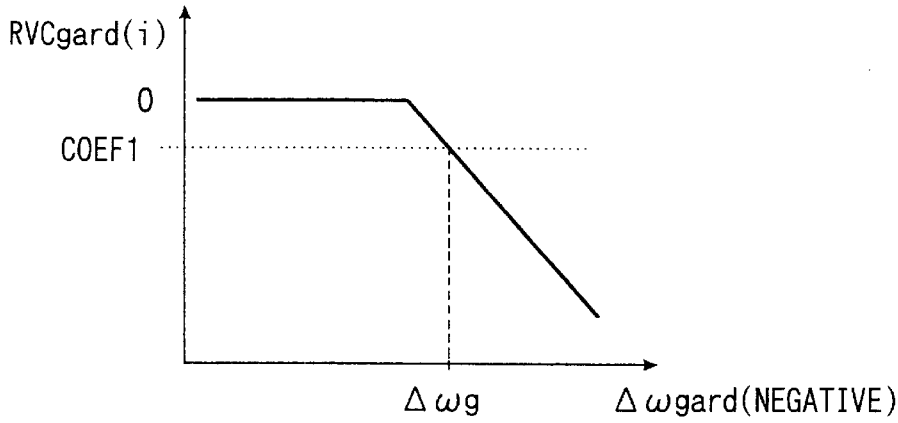
FIG. 25A
FIG. 25B
FIG. 25C
FIG. 25D
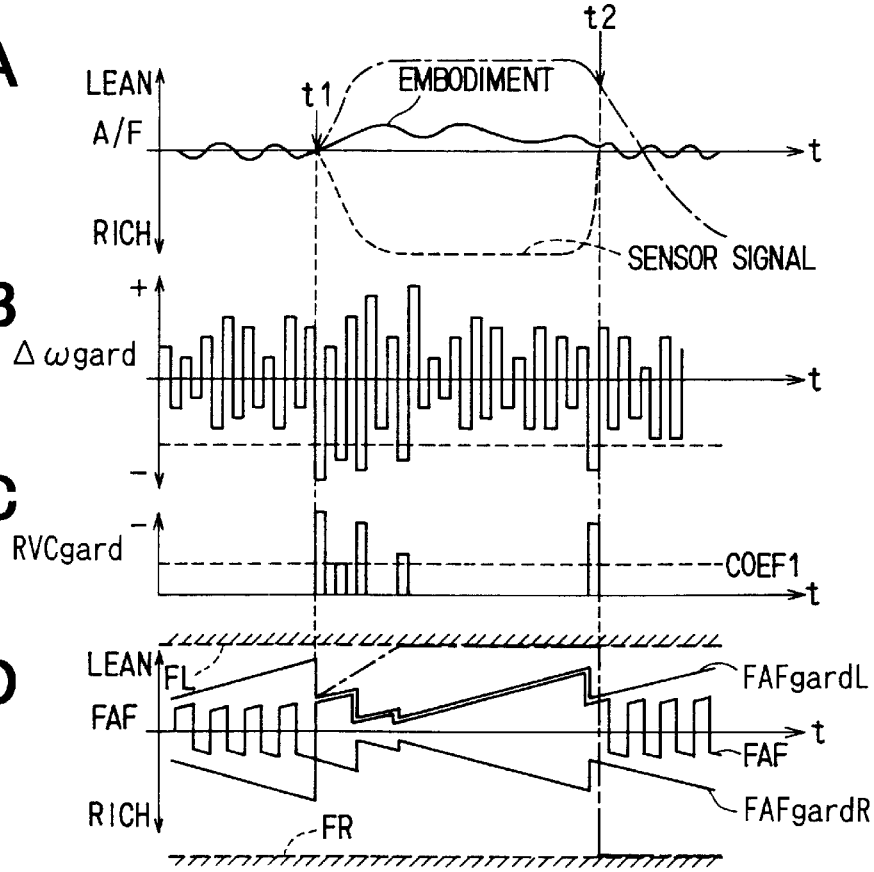

CONTROLLER FOR INTERNAL COMBUSTION ENGINE

CROSS REFERENCE TO RELATED APPLICATION

This application is based on Japanese Patent Applications No. 2001-215821 filed on Jul. 16, 2001 and No. 2001-232531 filed on Jul. 31, 2001 the contents of which are incorporated herein by reference.

BACKGROUD OF THE INVENTION

1. Field of the Invention

The present invention relates to a controller for an internal combustion engine and, more particularly, to a controller for an internal combustion engine, for controlling an air-fuel ratio of a mixture supplied to an internal combustion engine.

2. Related Art

Conventionally, an air-fuel ratio control of making the air-fuel ratio of a mixture supplied to an internal combustion engine (hereinbelow, also simply called an engine) coincide with a predetermined value is known. The air-fuel ratio control is effective to decrease a fuel consumption of an internal combustion engine and reduce emission of the internal combustion engine.

For example, a lean combustion control of setting the air-fuel ratio of an engine to a value on the lean side with respect to a stoichiometric air-fuel ratio is known. Particularly, a control of setting the air-fuel ratio to a value close to the lean limit of the engine is called a lean limit control. Under the lean limit control, the engine is operated at the leanest air-fuel ratio at which fluctuations in the revolution speed of the engine can be maintained at a predetermined value or less. Concretely, fluctuations in revolution is detected and a fuel injection amount is corrected by being decreased so as not to exceed a target revolution fluctuation. The target revolution fluctuation is set to a value at which drivability does not deteriorate. As a result, the air-fuel ratio is controlled to the leanest side within the range in which the fluctuation of revolution does not exceed the target value, that is, to a value close to the lean limit. In the lean limit control, however, hunting may occur in fluctuations of revolution in relation to the fuel injection amount. The hunting deteriorates drivability. Such a problem occurs in a control of correcting the fuel injection amount in accordance with engine speed.

On the other hand, the lean combustion is also executed at the time of a cold start of the engine. However, at the time of start, to start the engine reliably and stabilize the revolution of the engine early, special consideration is necessary. For example, at the time of a cold start, generally, the fuel injection amount is increased. However, when the lean combustion is performed, torque becomes insufficient. Consequently, the fuel injection amount is corrected to be decreased on the basis of a deviation between a reference engine speed and an actual engine speed in consideration of insufficient torque due to the lean combustion. In the control based on the deviation, however, drivability may deteriorate and, moreover, the problem of hunting also arises.

Further, there is a case that the air-fuel ratio of the engine is controlled on the basis of a signal from a sensor. For example, an O2 sensor for outputting a signal which is inverted at a predetermined air-fuel ratio in accordance with oxygen concentration or an A/F sensor for outputting a linear signal indicative of an air-fuel ratio in accordance with oxygen concentration is used. In such a control, control accuracy of the air-fuel ratio depends on the accuracy of a sensor signal. Consequently, when a sensor temporarily or continuously outputs an inaccurate signal having an error, the air-fuel ratio of the engine cannot be controlled properly.

SUMMARY OF THE INVENTION

An object of the invention is to provide a controller for an internal combustion engine, capable of suppressing deterioration in drivability.

Another object of the invention is to provide a controller for an internal combustion engine, for controlling the air-fuel ratio to the lean side while suppressing deterioration in drivability.

Further another object of the invention is to provide a controller for an internal combustion engine, for controlling the air-fuel ratio to the lean side at the time of a cold start while suppressing deterioration in drivability at the time of a cold start of an engine.

Further another object of the invention is to provide a controller for an internal combustion engine, capable of preventing an air-fuel ratio from reaching an abnormal value.

Further another object of the invention is to provide a controller for an internal combustion engine, capable of controlling an engine while preventing an excessive error of an air-fuel ratio in the case where a sensor for detecting the air-fuel ratio becomes abnormal.

According to a first feature of the invention, a correction value which suppresses engine speed fluctuations is selected and is used together with a lean correction value to correct the fuel injection amount.

The correction value which is set on the basis of an engine speed fluctuation amount is set to, for example, a value making combustion more stable as the engine speed fluctuation amount increases. As the engine speed fluctuation amount decreases, the fuel injection amount is decreased to set the combustion air-fuel ratio to the lean side. Final correcting means compares a correction value based on the engine speed fluctuation amount with a final correction value of last time and selects one of them as the correction amount which suppresses the engine speed fluctuation. As a result, a control of suppressing deterioration in drivability at the time of performing a lean control can be carried out.

A lean correction value may be set on the basis of a reference engine speed which is set as a reference value of the engine speed and an engine speed detected by engine speed detecting means. In such a manner, the lean correction value can be set in consideration of a torque margin required to set the air-fuel ratio to the lean side.

The engine speed fluctuation detecting means may obtain an angular velocity in each of a plurality of cylinders and detect fluctuations on the basis of variations of the angular velocity.

According to a second feature of the invention, a correction value for correcting a predetermined parameter is set on the basis of an engine speed fluctuation. Either the correction value or a final correction value of last time, which suppresses the engine speed fluctuations is selected and used for correcting the parameter of the internal combustion engine control.

With the configuration, a control can be executed while suppressing deterioration in drivability.

For example, in the case of executing an ignition timing retarding control for a catalyst early warm-up at the time of a cold start of an internal combustion engine, the invention can be applied to correction of an ignition timing.

The invention may be also applied to correction of a timing of opening an intake valve and/or an exhaust valve of a variable valve mechanism.

In the case where the target air-fuel ratio of lean combustion is set to a predetermined A/F value as shown by the solid line of FIG. 15, when the combustion air-fuel ratio becomes on the lean side, the engine speed fluctuation increases. In contrast, when the ignition timing becomes on the advance side as shown by the broken line and the alternate long and short dash line in the diagram, the air-fuel ratio at which the engine speed fluctuation increases shifts to the lean side with respect to the solid line. Consequently, when the retarded ignition timing for a catalyst early warm-up is set to a normal ignition timing on completion of the catalyst early warm-up or the like, since combustion performed at the ignition timing controlled on the advance side is more stable than combustion performed at the ignition timing controlled on the retard side, the engine speed fluctuation decreases.

Usually, in the case of controlling the target air-fuel ratio of lean combustion to a predetermined A/F value, if there is no means for detecting the air-fuel ratio such as an air-fuel ratio sensor at the time of a cold start, the fuel injection correction amount is computed on the basis of the engine speed fluctuation amount. However, when the engine speed fluctuation decreases due to completion of the catalyst early warm-up or the like as described above, the correction amount which is set on the basis of the engine speed fluctuation amount is set to the correction amount used for combustion at a lean air-fuel ratio. There is consequently possibility that combustion is carried out at a leaner air-fuel ratio.

According to a third feature of the invention, a basic fuel injection amount is corrected on the basis of an engine speed fluctuation amount by roughness correcting means, and the correction amount in the roughness correcting means is corrected on the basis of the value of a parameter exerting an influence on the engine speed fluctuation amount.

Thus, the air-fuel ratio is prevented from becoming leaner during a lean control.

As the parameter exerting an influence on the engine speed fluctuation amount, at least one of an ignition timing for performing a catalyst early warn-up in a cold start operation of the internal combustion engine, revolution speed of the internal combustion engine, and an intake air amount supplied to the internal combustion engine can be used.

According to a fourth feature of the invention, a guard value for a feedback correction factor is set on the basis of fluctuations in revolution speed of the internal combustion engine. In this specification a guard value is an upper limit or a lower limit, and a value is regulated by the guard value.

Thus, the actual air-fuel ratio can be suppressed from being deviated from a target air-fuel ratio.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 24 is a graph showing a function for setting a correction value of a guard value according to the fifth embodiment of the invention;

FIGS. 25A, 25B, 25C and 25D are time charts showing the operation of the fifth embodiment of the invention;

DETAILED DESCRIPTION OF THE PREFERRED EMBODIMENTS

First Embodiment

Figure 1:
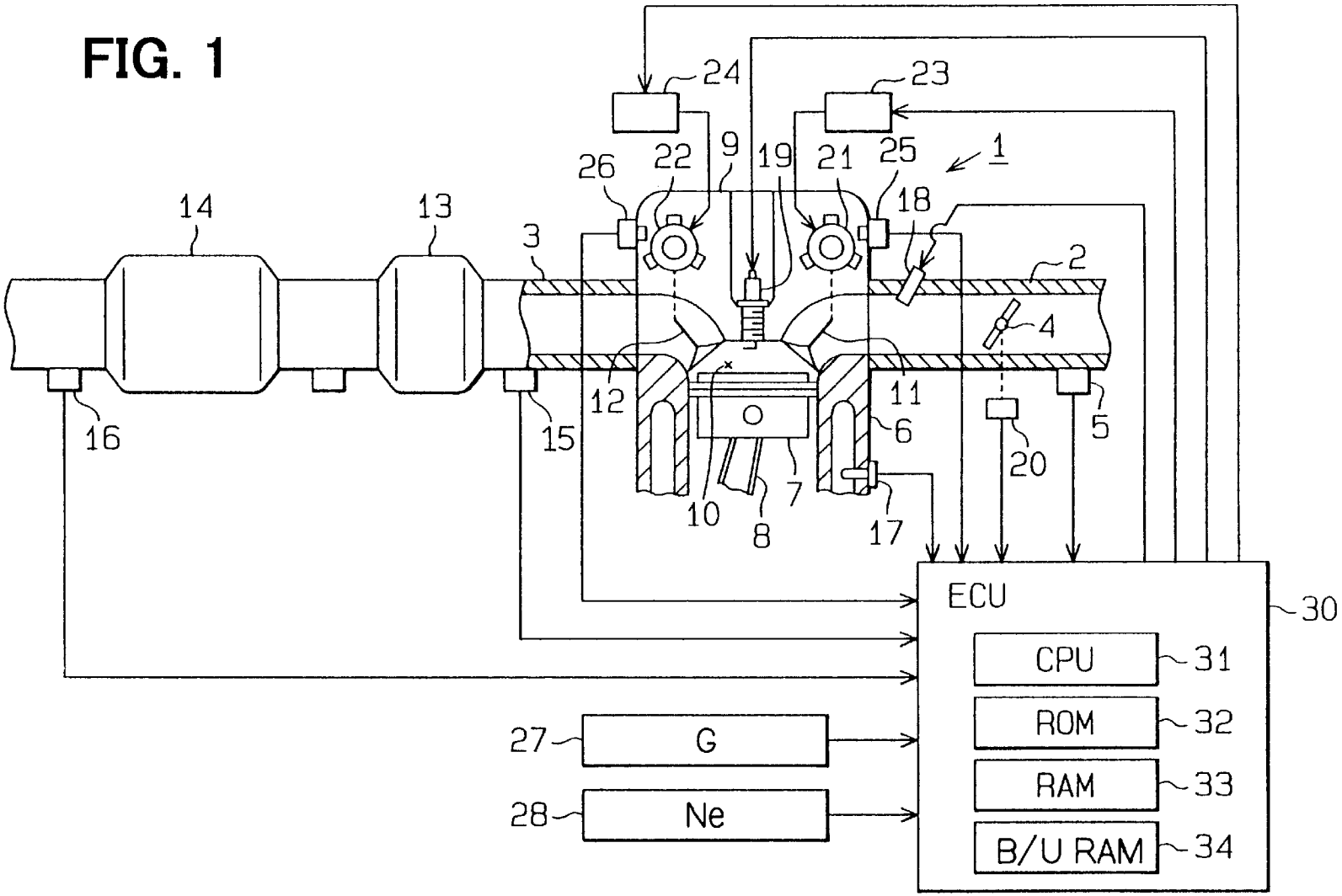
FIG. 1 is a block diagram of an engine controller according to a first embodiment of the invention.

FIG. 1 is a block diagram showing an engine controller.

In FIG. 1, an engine 1 is a spark-ignition type 4-cycle 4-cylinder internal combustion engine. An intake pipe 2 and an exhaust pipe 3 are connected to an intake port and an exhaust port of the engine 1, respectively. The intake pipe 2 is provided with a throttle valve 4 interlocked with a not-illustrated accelerator pedal, and an air flow meter 5 for detecting the amount of intake air. The opening angle of the throttle valve 4 is detected by a throttle sensor 20. The throttle sensor 20 also detects the fully closed state of the throttle valve 4.

A piston 7 which reciprocates in the vertical direction of the drawing is disposed in a cylinder 6 of the engine 1 and coupled to a not-illustrated crankshaft via a connecting rod 8. A combustion chamber 10 defined by the cylinder 6 and a cylinder head 9 is formed above the piston 7. The combustion chamber 10 is communicated with the intake pipe 2 and the exhaust pipe 3 via an intake valve 11 and an exhaust valve 12, respectively. The cylinder (water jacket) 6 is provided with a water temperature sensor 17 for detecting the temperature of engine cooling water.

The exhaust pipe 3 is provided with two catalytic converters 13 and 14. The catalytic converters 13 and 14 are three-way catalytic converters for reducing three components of HC, CO, and NOx in exhaust gas. The catalytic converter 13 on the upstream side has a capacity smaller than that of the catalytic converter 14 on the downstream side, and has the role of a so-called start catalyst which warms up relatively early immediately after the engine starts. The catalytic converter 13 on the upstream side is provided in a position apart from the engine exhaust port end face by about 300 mm.

On the upstream side of the catalytic converter 13, an A/F sensor 15 which is a limiting current type air-fuel ratio sensor is provided. The A/F sensor 15 outputs a linear air-fuel ratio signal in a wider range as compared with oxygen concentration in an exhaust gas (or concentration of carbon monoxide in an unburned gas). On the downstream side of the catalytic converter 14, an O2 sensor 16 for outputting a voltage signal which varies in accordance with the rich side or lean side with respect to the stoichiometric air-fuel ratio as a border is provided.

A high-pressure fuel is supplied from a not-illustrated fuel supply system to an electromagnetic driving type injector 18, and the injector 18 supplies the fuel by injection to the engine intake port in association with passage of a current. A multi point injection (MPI) system having the injectors 18 each provided for each of branch pipes of the intake manifold is constructed. A spark plug 19 provided for the cylinder head 9 sparks by a high voltage for spark supplied from a not-illustrated igniter.

A fresh air supplied from the upstream of the intake pipe and a fuel injected by the injector 18 are mixed at the engine intake port, and the mixture flows into the combustion chamber 10 in association with an opening operation of the intake valve 11. The fuel flowed in the combustion chamber 10 is ignited by a spark generated by the spark plug 19 and provided for combustion.

An intake-side camshaft 21 for opening/closing the intake valve 11 at a predetermined timing and an exhaust-side camshaft 22 for opening/closing the exhaust valve 12 at a predetermined timing are interlocked with the crankshaft via a not-illustrated timing belt and the like. The intake-side camshaft 21 is provided with an intake-side hydraulic variable valve timing mechanism (VCT) 23, and the exhaust-side camshaft 22 is similarly provided with an exhaust-side hydraulic-type variable valve timing mechanism (VCT) 24.

The VCTs 23 and 24 are provided as phase adjusting type variable valve timing mechanisms for adjusting relative rotational phases between the camshafts 21 and 22 on the intake and exhaust sides and the crankshaft. The operations of the VCTs 23 and 24 are adjusted in accordance with a hydraulic control by a not-illustrated solenoid valve. Specifically, according to the control amounts of the VCTs 23 and 24, the camshafts 21 and 22 on the intake and exhaust sides rotate to the retard or advance side with respect to the crankshaft, and the timings of opening/closing the intake and exhaust valves 11 and 12 shift to the retard or advance side in accordance with the operations.

The intake-side camshaft 21 is provided with an intake-side cam position sensor 25 for detecting the rotation position of the camshaft 21. The exhaust-side camshaft 22 is provided with an exhaust-side cam position sensor 26 for detecting the rotation position of the camshaft 22.

An electronic control unit (ECU) 30 is constructed by mainly a microcomputer including a CPU 31, a ROM 32, a RAM 33, and a backup RAM 34. The ECU 30 receives detection signals of the air flow meter 5, A/F sensor 15, O2 sensor 16, water temperature sensor 17, throttle sensor 20, and cam position sensors 25 and 26. On the basis of the detection signals, the ECU 30 detects engine operating conditions such as an intake air amount Qa, air-fuel (A/F) ratios on the upstream and downstream sides of the catalyst, engine water temperature Tw, throttle angle, and cam position. To the ECU 30, a reference position sensor 27 for outputting a pulse signal every 720° CA (Crank angle degrees) and a rotational angle sensor 28 for outputting a pulse signal every smaller crank angle (for example, every 30° CA) are connected. The ECU 30 receives the pulse signals from the sensors 27 and 28 and detects a reference crank position (G signal) and engine speed Ne.

On the basis of the various engine operating conditions detected as described above, the ECU 30 executes a control on fuel injection by the injector 18, a control on the ignition timing by the spark plug 19, and a control on the opening/closing timings of the intake and exhaust valves 11 and 12 by the variable valve timing mechanisms 23 and 24.

Figure 2:
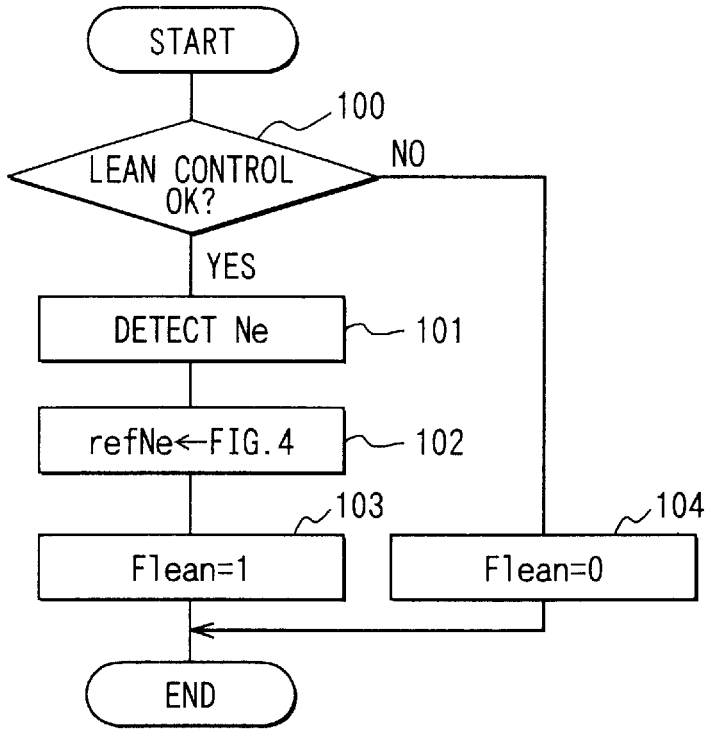
FIG. 2 is a flowchart showing an execution condition determining process according to the first embodiment of the invention.

A lean control program executed by the ECU 30 will described in detail hereinbelow. First, in the flowchart of FIG. 2, a process of determining conditions of executing the lean control is performed. The flowchart shows a routine which is repeatedly started every 8 ms (millisecond). In step 100, whether conditions for executing the lean control are satisfied or not is determined. In the determination of the execution conditions, when all of the conditions such that, for example, the engine 1 is already started, a predetermined period has not been elapsed yet since the start, and a feedback control is open are satisfied, it is determined that the execution conditions are satisfied.

When it is determined that the execution conditions are not satisfied, the program advances to step 104 where 0 is set to a flag Flean and the routine is finished. On the other hand, when the execution conditions in step 100 are satisfied, processes in step 101 and subsequent steps are executed. In step 101, actual engine speed Ne is detected. In step 102, on the basis of elapsed time Tst since the start and the engine water temperature Tw, a reference engine speed refNe is read from the map shown in FIG. 4. The reference engine speed refNe is a reference value of the actual engine speed Ne and used to determine a torque margin to execute the lean control. The details of the reference engine speed refNe will be described in steps 111 and 112 in FIG. 3.

Finally, in step 103, 1 is set to the flag Flean and the routine is finished.

Subsequently, a program for setting a fuel injection amount for the lean control will be described by using the flowchart of FIG. 3. This program is a routine started every 180° CA of the crankshaft of the engine 1. In step 110, whether 1 is set in the flag Flean or not is determined. If Flean=0, the program advances to step 114. In step 114, 0 is set to a lean correction value RVClean for correcting a basic fuel injection amount Tp in order to control the air-fuel ratio of the internal combustion engine to be leaner than the stoichiometric air fuel ratio, and the program advances to step 115. 0 is set as an initial value in the lean correction value RVClean.

On the other hand, when it is determined in step 110 that the flag Flean=1, the program advances to step 111. In step 111, on the basis of the actual engine speed Ne and the reference engine speed refNe, a torque margin ΔNe of the engine 1 is computed.

The reference engine speed refNe is used as a reference value to be compared with the actual engine speed Ne at the time of executing the lean control. Usually, in idle operation of the internal combustion engine, the engine speed Ne is controlled to be a predetermined target engine speed Netg by controlling an intake air and the like. However, in the lean control, combustion is controlled so as to be performed on the leaner side than the stoichiometric air fuel ratio, so that the torque is lower as compared with that in the combustion at the stoichiometric air-fuel ratio. Specifically, in the case where the engine speed Ne drops, the engine speed Ne cannot be recovered to the target engine speed Netg only by controlling the intake air amount.

In the embodiment, therefore, the torque margin ΔNe is obtained as a deviation between the reference engine speed refNe and the engine speed Ne. When the torque margin ΔNe is large, the air-fuel ratio of this time is controlled to be leaner as compared with the air-fuel ratio of last time. When the torque margin ΔNe is small, the air-fuel ratio of this time is controlled to be richer as compared with the air-fuel ratio of last time. In such a manner, the engine speed Ne is controlled, and the air-fuel ratio is controlled to the lean side as much as possible.

Figure 3:
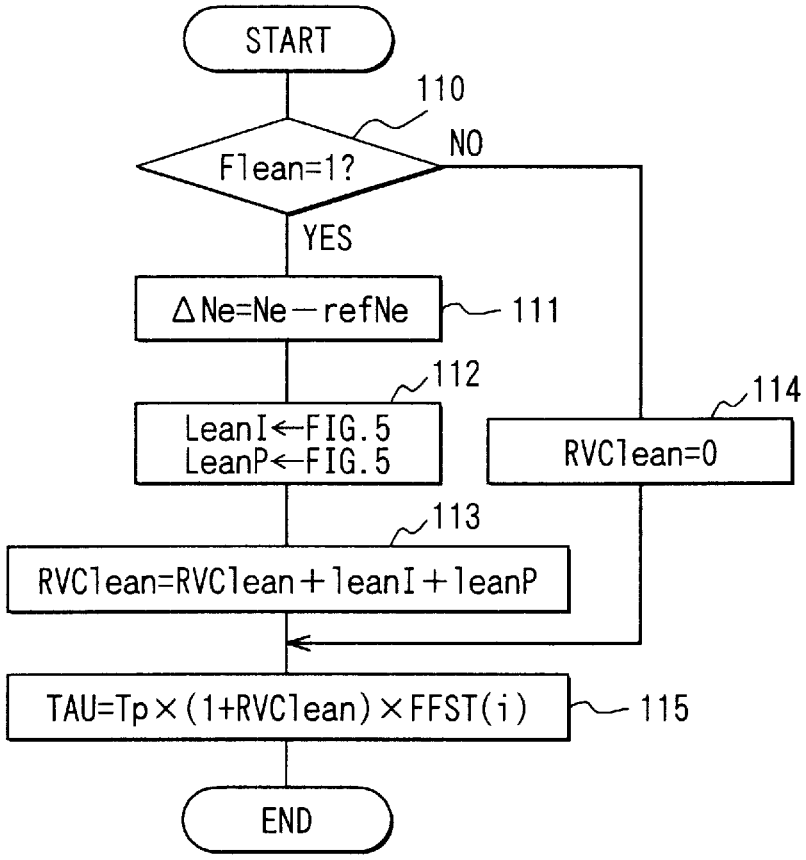
FIG. 3 is a flowchart showing a fuel injection amount computing process according to the first embodiment of the invention.
Figures 4, 5:
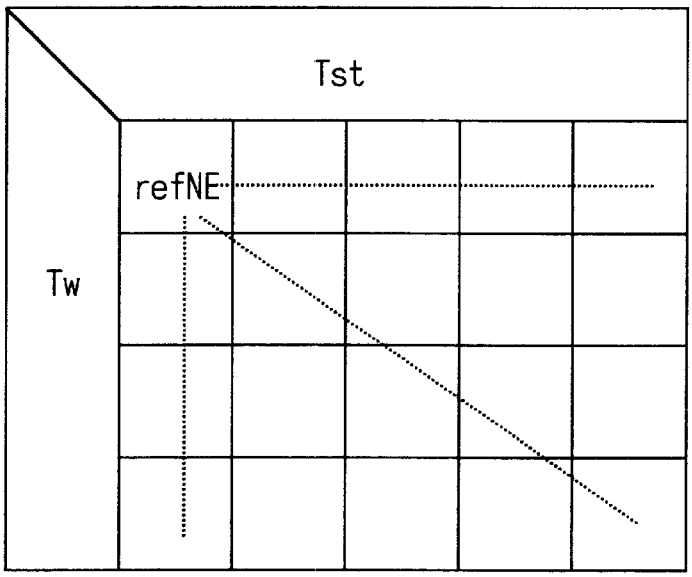
FIG. 4 is a map for setting a reference engine speed according to the first embodiment of the invention.
FIG. 5 is a map for setting a lean correction value according to the first embodiment of the invention.

Referring again to the flowchart of FIG. 3, in step 112, correction terms leanI and leanP for the basic fuel injection amount used to perform the lean control are read from a map shown in FIG. 5 or the like on the basis of the computed torque margin ΔNe. In the map of FIG. 5, the correction terms leanI and leanP according to the torque margin ΔNe are set. For example, when the torque margin ΔNe is +20, $leanI_{20}$ is set as leanI, and $leanP_{20}$ is set as leanP. The correction terms leanI and leanP may be calculated by calculation using a numerical expression.

Subsequently, from the correction terms leanI and leanP computed in step 112 and the basic correction value RVClean(i−1) of last time, a correction value RVClean(i) of this time is calculated. In step 115, a fuel injection amount TAU is computed. The fuel injection amount TAU is calculated by multiplying a conventionally-known basic fuel injection amount Tp with various correction factors FAWE. In addition, in the embodiment, by multiplying the correction value RVClean(i) for the lean control and a final correction value FFST(i) for preventing deterioration in drivability, the fuel injection amount TAU is calculated.

Figure 6:
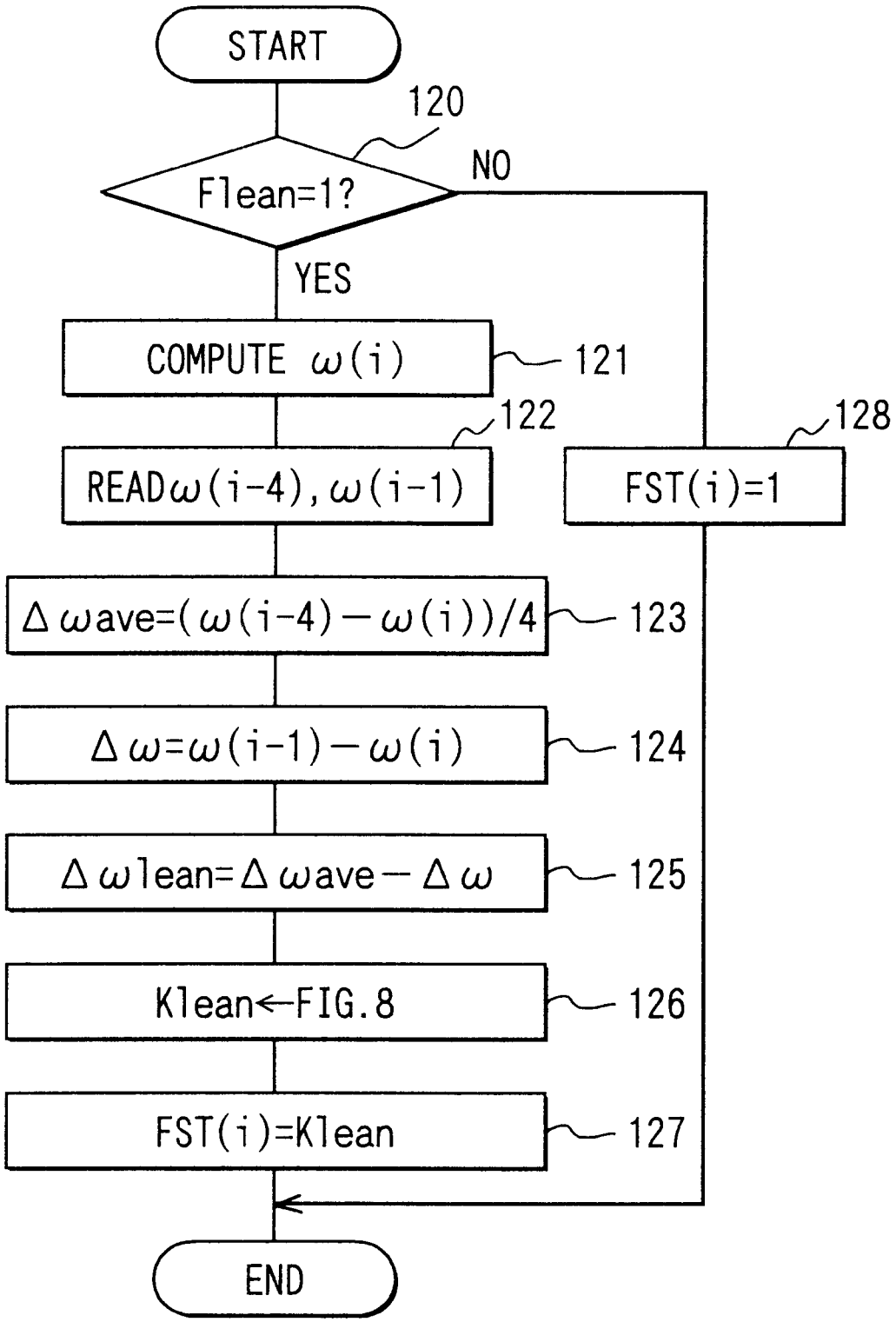
FIG. 6 is a flowchart showing a roughness detecting process according to the first embodiment of the invention.

A correcting process for preventing deterioration in drivability will now be described. In the embodiment, a correction value FST(i) is obtained as a primary correction value according to roughness. After that, the correction value FST(i) is subjected to a hunting preventing process, thereby obtaining the final correction value FFST(i). It is known that in the driving with lean combustion, usually, combustion is unstable as compared with that in the driving at the stoichiometric air-fuel ratio. That is, when the air-fuel ratio is continued to be lean in consideration of the fuel consumption and emission, the combustion becomes unstable, so that the engine speed Ne fluctuates. Since the fluctuations in the engine speed Ne cause deterioration in drivability, it is necessary to suppress fluctuations in the engine speed Ne. The correction value FST(i) is therefore set so that fluctuations in the engine speed Ne do not increase due to the lean control. The flowchart of FIG. 6 shows a program started every 180° CA. First, in step 120, the flag Flean is 1 or not is determined. If the flag Flean is 0, the program advances to step 128. In step 128, 1 is set as the correction value FST(i), and the routine is finished.

On the other hand, when it is determined in step 120 that the flag Flean=1, the program advances to step 121. In step 121, an angular velocity ω(i) is computed. It is sufficient to compute the angular velocity ω(i) by a conventionally-known method. For example, the angular velocity ω(i) is obtained by computing time required for a not-shown crankshaft to turn by 30° CA. The value ω(i) is stored into the RAM 33 in the ECU 30.

In step 122, angular velocities ω(i−1) and ω(i−4) of the past stored in the RAM 33 are read. The angular velocity ω(i−1) is an angular velocity computed last time and the angular velocity ω(i−4) is an angular velocity computed four times ago. In steps 123, 124, and 125, a fluctuation amount of the engine speed Ne is computed from the angular velocities ω(i), ω(i−1), and ω(i−4). First, in the computation of step 123, an average angular velocity deviation Δωave between 0° CA to 720° CA is calculated and, after that, the program advances to step 124.

Figure 7:
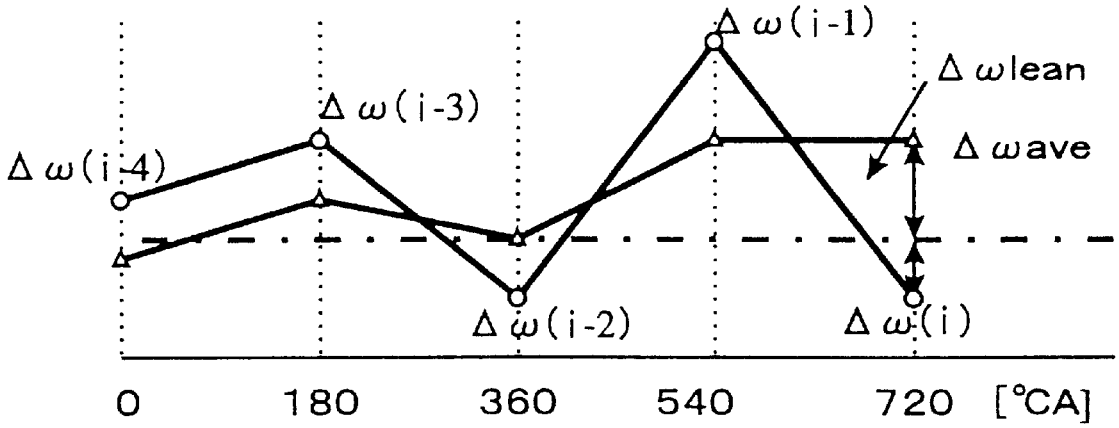
FIG. 7 is a time chart showing the roughness detecting process according to the first embodiment of the invention.

In step 124, the angular velocity deviation Δω through 180° CA between the angular velocity (i) of this time and the angular velocity ω(i−1) of last time is calculated. In step 125, on the basis of the average angular velocity deviation Δωave calculated in step 123 and the angular velocity deviation Δω through 180° CA, a detected roughness value Δωlean is calculated as an index indicative of the engine speed fluctuation amount. In the time chart shown in FIG. 7, the angular velocity deviation Δω through 180° CA is indicated by the sign "o", and the average angular velocity deviation Δωave is indicated by the sign "Δ". Δωlean denotes a value obtained by subtracting the angular velocity deviation Δω through 180° CA from the average angular velocity deviation Δωave. Δωlean is an index which shows that when it is large, the engine fluctuation amount is large, and when Δωlean is small, the engine fluctuation amount is small.

Figure 8:
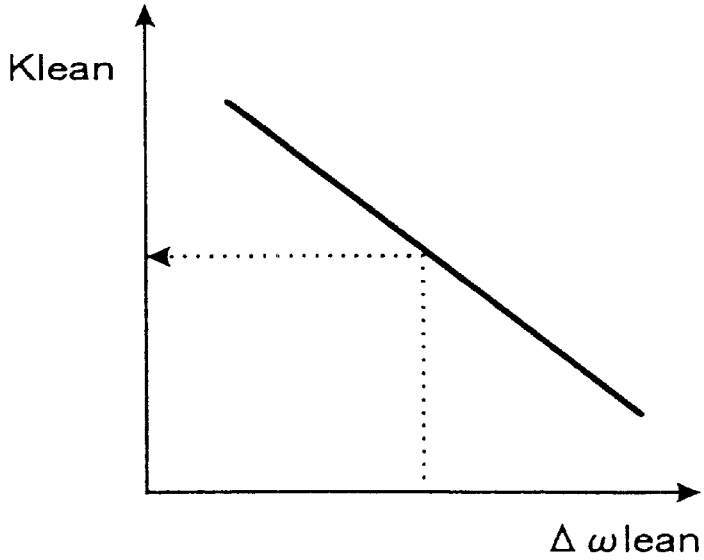
FIG. 8 is a graph showing a function for setting a correction value corresponding to roughness according to the first embodiment of the invention.

In step 126, a roughness feedback correction value Klean is set on the basis of the detected roughness value. The roughness feedback correction value Klean is set by, for example, using the map of FIG. 8. According to the map of FIG. 8, the larger the detected roughness value Δωlean is, Klean is set so that the fuel injection amount becomes larger than the fuel injection amount of last time. The roughness feedback correction value Klean is set in such a manner and is set as FST(i) in step 127 and, after that, the routine is finished.

Only by performing the roughness feedback on the basis of the detected roughness value Δωlean, it is feared that the drivability deteriorates. For example, since the correction term Klean is set on the basis of the detected roughness value Δωlean by feedback, when the detected roughness value Δωlean fluctuates largely, the correction term Klean also largely changes. Consequently, when the fuel injection amount TAU largely fluctuates due to the roughness feedback control, the combustion air-fuel ratio largely fluctuates. That is, hunting occurs, and deterioration in drivability is worsened.

Figure 9:
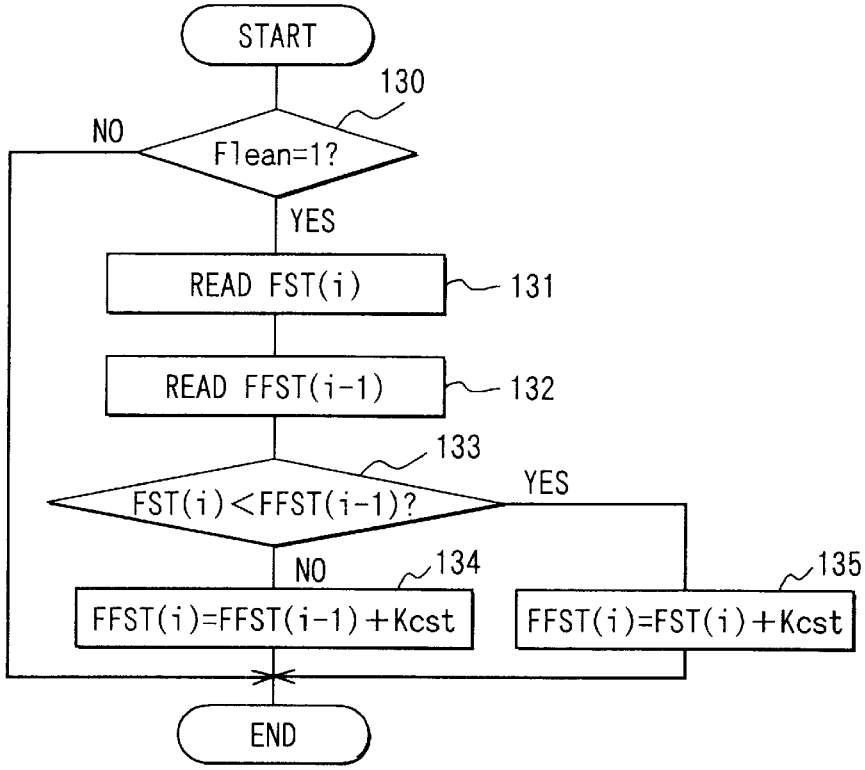
FIG. 9 is a flowchart showing a final correction value computing process according to the first embodiment of the invention.

In the embodiment, therefore, by a program shown in the flowchart of FIG. 9, the final correction value FFST(i) is calculated. The program is a routine started each time the crankshaft turns by 180° CA.

First, in step 130, whether 1 is set in the flag Flean or not is determined. If NO, the routine is finished. On the other hand, if YES, the program advances to step 131. In step 131, the correction value FST(i) of this time which is set in step 127 in FIG. 6 is read. In the following step 132, the final correction value FFST(i) of last time is read.

In step 133, the correction value FST(i) of this time and the final correction value FFST(i−1) of last time are compared with each other. If the correction value FST(i) of this time is smaller than the final correction value FFST(i−1) of last time, the program advances to step 135. In step 135, a value obtained by adding a predetermined value Kcst to the correction value FST(i) of this time is set as a final correction value FFST(i), and the routine is finished. On the other hand, when the final correction value FFST(i−1) of last time is smaller than the correction value FST(i) of this time, the program advances to step 134. In step 134, a value obtained by adding the predetermined value Kcst to the final correction value FFST(i−1) of last time is set as the final correction value FFST(i) of this time, and the routine is finished.

Figures 10A, 10B, 10C, 10D, 10E, 10F:
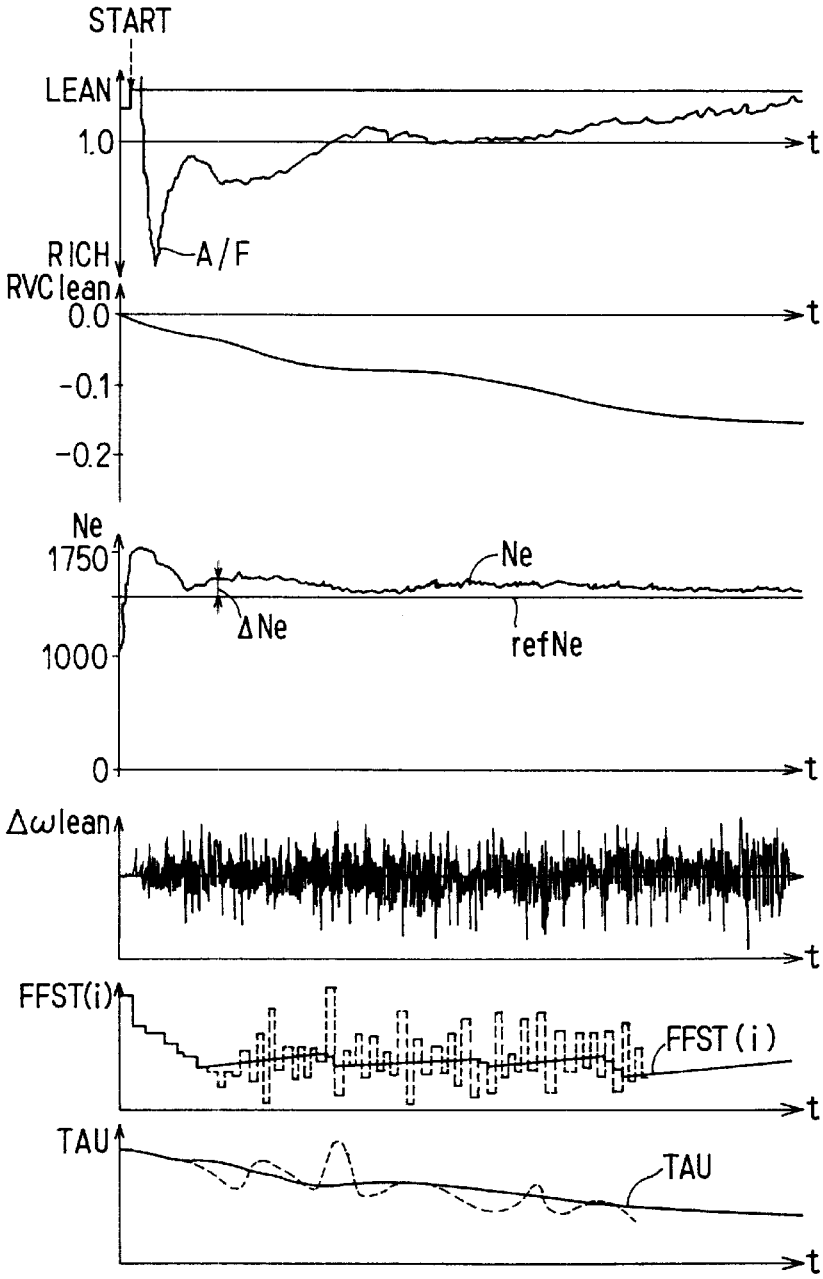
FIGS. 10A, 10B, 10C, 10D, 10E and 10F are time charts showing the operation of the first embodiment of the invention.

Such a control will now be described by using time charts of FIGS. 10A to 10F. FIG. 10C is a diagram showing the engine speeds which are the actual engine speed Ne and the reference engine speed refNe. In the embodiment, according to the deviation ΔNe, the lean correction value RVClean decreases as shown in FIG. 10B. With the lean correction value RVClean, the fuel injection amount TAU decreases, and the air-fuel ratio shifts to the lean side as shown in FIG. 10A. When the correction value FFST(n) is set according to only the detected roughness value of FIG. 10D, as shown by broken lines in FIG. 10E, there is the possibility that the correction value frequently fluctuates, as shown in FIG. 10F, hunting occurs in the fuel injection amount TAU, and it accelerates fluctuations in rotation.

In the embodiment, by the processes of FIG. 9, the correction value which suppresses roughness of the engine is selected. When it is determined on the basis of the detected roughness value that the fluctuations in engine speed are stable, the value obtained by adding the predetermined value Kcst to the final correction value FFST(i−1) of last time is selected. When the fluctuations in the engine speed increase, the correction value FST(i) which is set according to the detected roughness value is selected as the final correction value FFST(i). In such a manner, as shown by the solid line in FIG. 10F, when the engine speed fluctuations are stable, the fuel injection amount TAU is gradually decreased. On the other hand, when the engine speed fluctuation occurs, the control of rapidly increasing the fuel injection amount can be performed. Thus, without deteriorating drivability, the air-fuel ratio lean control can be executed stably.

Second Embodiment

In the second embodiment, correction of an ignition timing will be described.

In the embodiment, the same or similar component as that in the first embodiment is designated by the same reference numeral and the description will not be repeated. The second embodiment employs the configuration of FIG. 1.

In the embodiment, an ignition timing control in a catalyst early warm-up at the time of a cold start as operating conditions in which the ignition timing is controlled to a retard side will be described. The ignition timing at the time of a catalyst early warm-up is set to the retard side in order to positively increase the temperature of the catalyst. By retarding the ignition timing, combustion is made slow, and the temperature of components of the exhaust gas is increased, thereby enabling the catalyst to be warmed early. When the ignition timing is retarded, however, combustion becomes unstable. The engine speed Ne accordingly fluctuates. The fluctuation amount of the engine speed Ne is one of factors of making the driver feel strange and deteriorating drivability.

Figure 11:
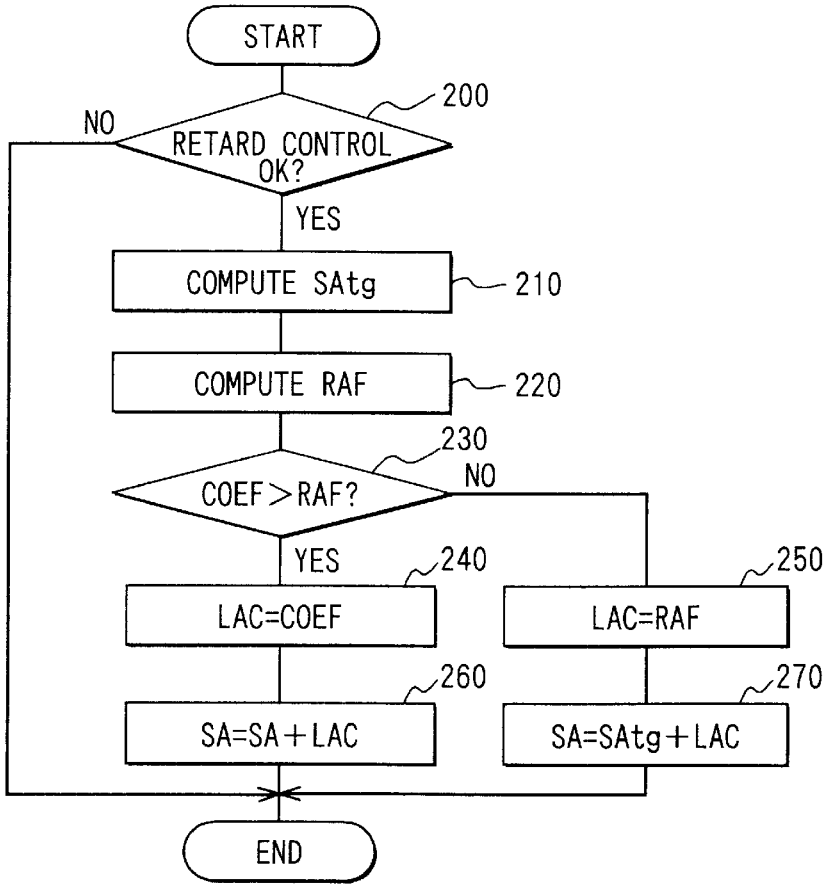
FIG. 11 is a flowchart showing an ignition timing correcting process according to a second embodiment of the invention.

In the embodiment, therefore, a target ignition timing SAtg is corrected. In the correcting process, either a roughness correction value RAF according to the fluctuation amount of the engine speed Ne or a predetermined correction value COEF, which suppresses the fluctuations in the engine speed more is selected. The selected value is set as a final correction value LAC. The ignition timing control will now be described according to the flowchart of FIG. 11.

First, in step 200, conditions of executing an ignition timing retarding control are determined. The conditions of executing the ignition timing regarding control are such that the engine is in an idle operating state, and the engine cooling water temperature Thw is equal to or lower than a predetermined water temperature. When the execution conditions are not satisfied, the routine is finished. On the other hand, when it is determined that the execution conditions are satisfied, the program advances to step 210. In step 210, on the execution conditions of the ignition timing retarding control, the target ignition timing SAtg is set from a map based on the engine operating conditions or the like, and the program advances to step 220.

In step 220, the roughness correction value RAF is computed from a map based on the fluctuation amount of the engine speed Ne or the like. The fluctuation amount ΔNe of the engine speed Ne may be computed by, for example, a method of calculating the detected roughness value Δωlean in step 126 in FIG. 6 used in the first embodiment. Other methods can be also employed as long as the fluctuations in the engine speed Ne are detected. As the roughness correction value RAF, a value which corrects the ignition timing more largely to the advance side as the fluctuation amount of the engine speed Ne increases is set.

In step 230, by comparing the roughness correction value RAF with the correction value COEF, the final correction value LAC which suppresses the fluctuation amount of the engine speed Ne is set. The correction value COEF is a predetermined correction amount and is a value which sets the ignition timing to the regard side. The final correction value LAC will be described in steps 240 and 250. When it is determined in step 230 that the predetermined correction value COEF is larger than the roughness correction value RAF in step 230, the program advances to step 240. In step 240, the correction value COEF is set as the final correction value LAC, and the program advances to step 260. In step 260, a value obtained by adding the correction value COEF to the ignition timing SA of last time is set as the ignition timing SA, and the routine is finished.

On the other hand, when it is determine din step 230 that the roughness correction value RAF is larger than the predetermined correction value COEF, the program advances to step 250 where the roughness correction value RAE is set as the final correction value LAC, and the program advances to step 270. In step 270, the ignition timing SA is set by adding the final correction value LAC to the target ignition timing SAtg. After that, the routine is finished.

Figures 12A, 12B, 12C, 12D:
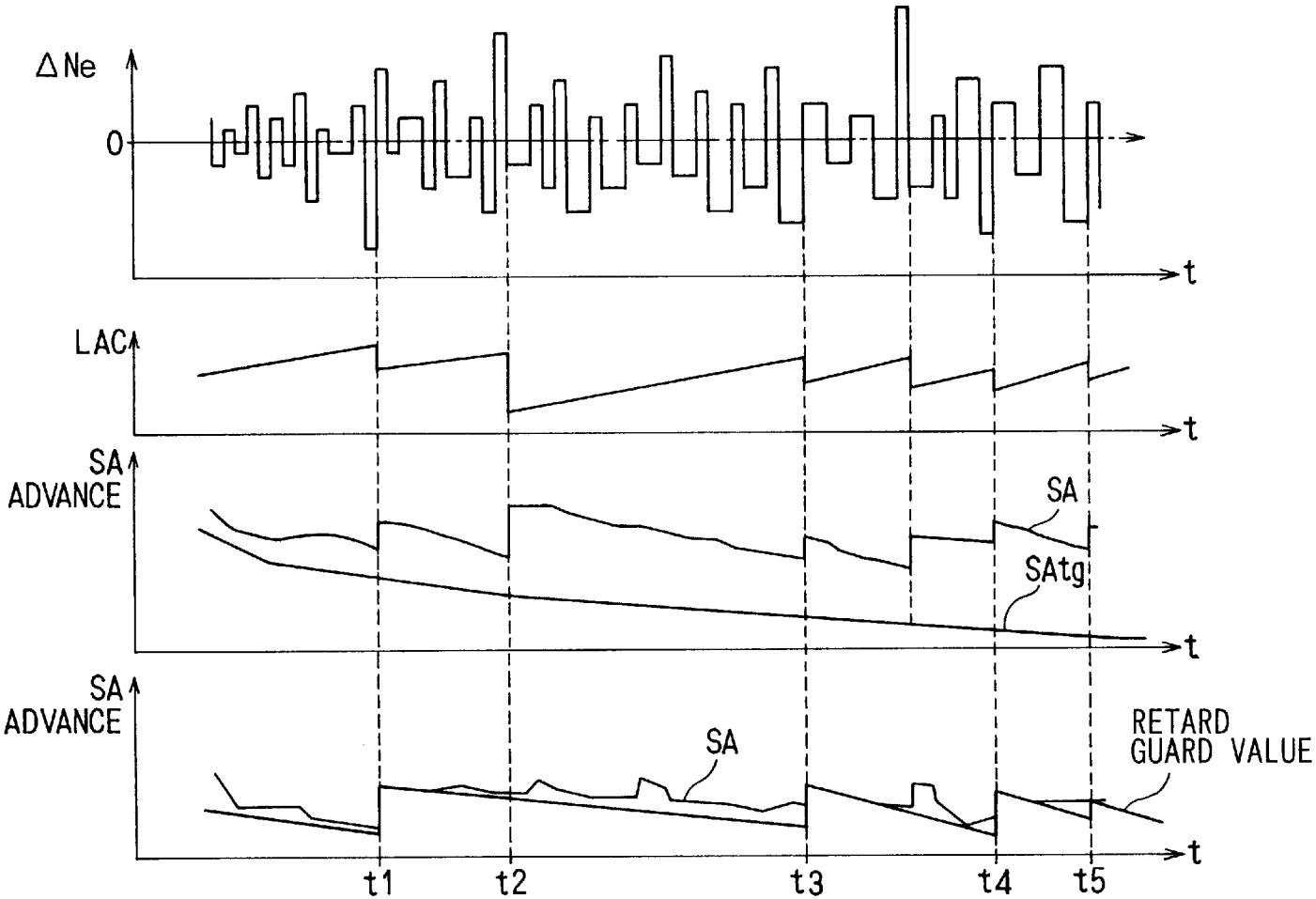
FIGS. 12A, 12B, 12C and 12D are time charts showing the operation of the second embodiment of the invention.

The control program will now be described by using the time chart of FIGS. 12A to 12D. FIG. 12A shows a fluctuation amount of the engine speed Ne. FIG. 12B shows the final correction value LAC. As the final correction value LAC, until the fluctuation amount of the engine speed Ne becomes large, the correction value COEF is set. When the fluctuation amount of the engine speed Ne becomes large, a correction amount which advances the ignition timing by a predetermined value is set. When the fluctuation amount ΔNe (a value corresponding to roughness) becomes large, the roughness correction value RAE which largely advances the ignition timing in accordance with the value corresponding to roughness is set as the final correction value LAC. At times t1, t2, t3, t4, and t5 of FIG. 12A, RAF is set. On the basis of the final correction value LAC, as shown in FIG. 12C, the target ignition timing SAtg is corrected, thereby obtaining the ignition timing SA after correction. In the correction, when the value corresponding to roughness is small, the ignition timing is gradually retarded. When the value corresponding to roughness becomes large, the ignition timing is largely advanced.

In place of the embodiment, a method of controlling the ignition timing as shown in FIG. 12D may be used. FIG. 12D shows a case where a guard value on the retard side of the ignition timing SA is subjected to correction according to the value corresponding to roughness. As the value corresponding to roughness increases, the limit value on the retard side of the ignition timing is largely advanced, so that the fluctuation amount of the engine speed Ne can be suppressed.

As described above, in the embodiment, as the value corresponding to roughness increases, the ignition timing is largely advanced. When the value corresponding to roughness is small, the ignition timing is gradually set to the regard side. Thus, occurrence of hunting in the ignition timing can be prevented. As a result, the ignition timing is set to a value which is most retarded to an extent that the drivability does not deteriorate. Thus, the catalyst early warm-up can be performed without deteriorating the drivability.

The invention may be also used for an ignition timing knocking control. In this case, when the value corresponding to roughness is small, the ignition timing is gradually advanced. When the value corresponding to roughness becomes large, the ignition timing is largely retarded by the retard correction amount according to the value corresponding to roughness, thereby enabling the ignition timing to be controlled near to the knock limit with high accuracy.

It is also possible to set the final correction value LAC as a coefficient to be multiplied and perform a process.

Third Embodiment

In a third embodiment, a control according to the fluctuation value ΔNe of the engine speed Ne is applied to an intake valve timing control system. When the timing of opening the intake valve is advanced over the top dead center TDC of the engine, a state in which the exhaust and intake valves are simultaneously open becomes long. When such a state becomes long, a combustion gas remaining in a combustion chamber is taken again into the combustion chamber and so-called internal EGR gas increases. It is known that an increase in the internal EGR gas makes combustion unstable.

Figure 13:
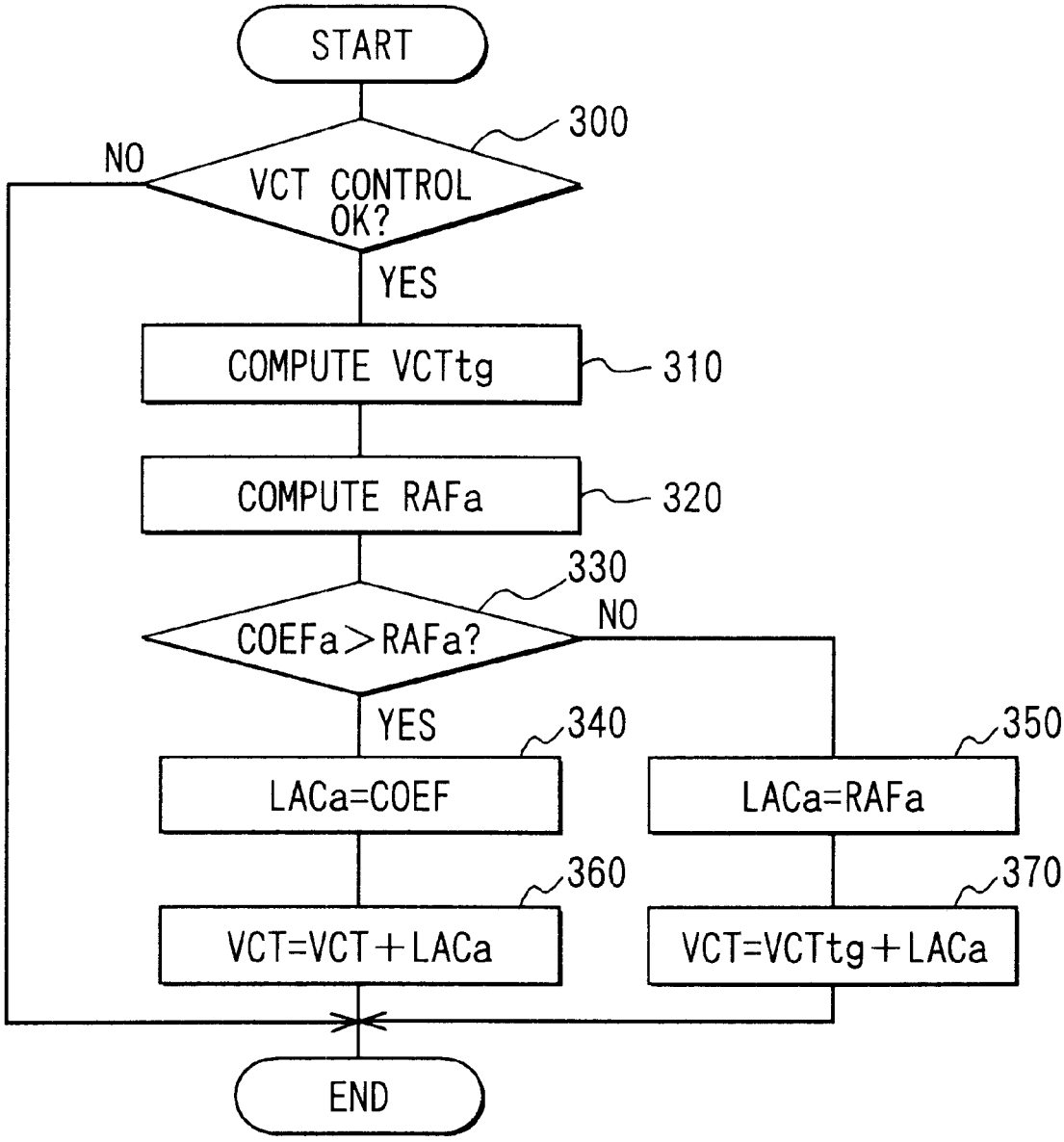
FIG. 13 is a flowchart showing a valve timing control process according to a third embodiment of the invention.

The flowchart of FIG. 13 shows a program for setting the timing of opening a VCT, and the routine which is started every 180° CA. First, in step 300, whether the condition of executing the program is satisfied or not is determined. The execution condition is that the engine is in an operating state where the timing of opening the VCT is variably set. If the execution condition is not satisfied, the routine is finished. On the other hand, if the execution condition is satisfied, the program advances to the processes of step 310 and subsequent steps.

In step 310, a target valve opening timing VCTtg according to the operating conditions is computed from a map or the like on the basis of a load on the engine, engine speed Ne, engine cooling water temperature Tw, and the like. After that, the program advances to step 320. In step 320, the roughness correction amount is computed from a map based on the fluctuation amount of the engine speed Ne or the like. The fluctuation amount of the engine speed Ne may be computed by, for example, a method of calculating the detected roughness value Δωlean in step 126 in the flowchart of FIG. 6 used in the first embodiment. Other methods may be also used as long as the fluctuations in the engine speed Ne are detected. As the fluctuation amount of the engine speed Ne increases, the roughness correction value RAF which corrects the valve opening timing VCT more largely to the retard side is set.

In step 330, the larger correction value between a correction value COEFa and a roughness correction value RAFa is determined. In this case, the correction value COEFa is a constant value which is set to gradually advance the valve opening timing. If it is determined that the correction value COEFa is larger than the roughness correction value RAFa, the program advances to step 340. In step 340, the correction value COEFa is set as the final correction value LACa. After that, the program advances to step 360 where a value obtained by adding the final correction value LACa to the valve opening timing VCT of last time is set as the valve opening timing VCT, and the routine is finished.

On the other hand, when it is determined in step 330 that the roughness correction value RAFa is larger than the correction value COEFa, the program advances to step 340 where the roughness correction value RAFa is set as the final correction value LACa. The program advances to step 370 where a value obtained by adding the final correction value LACa to the target valve opening timing VCTtg is set as the valve opening timing VCT, and the routine is finished.

Figures 14A, 14B, 14C, 14D:
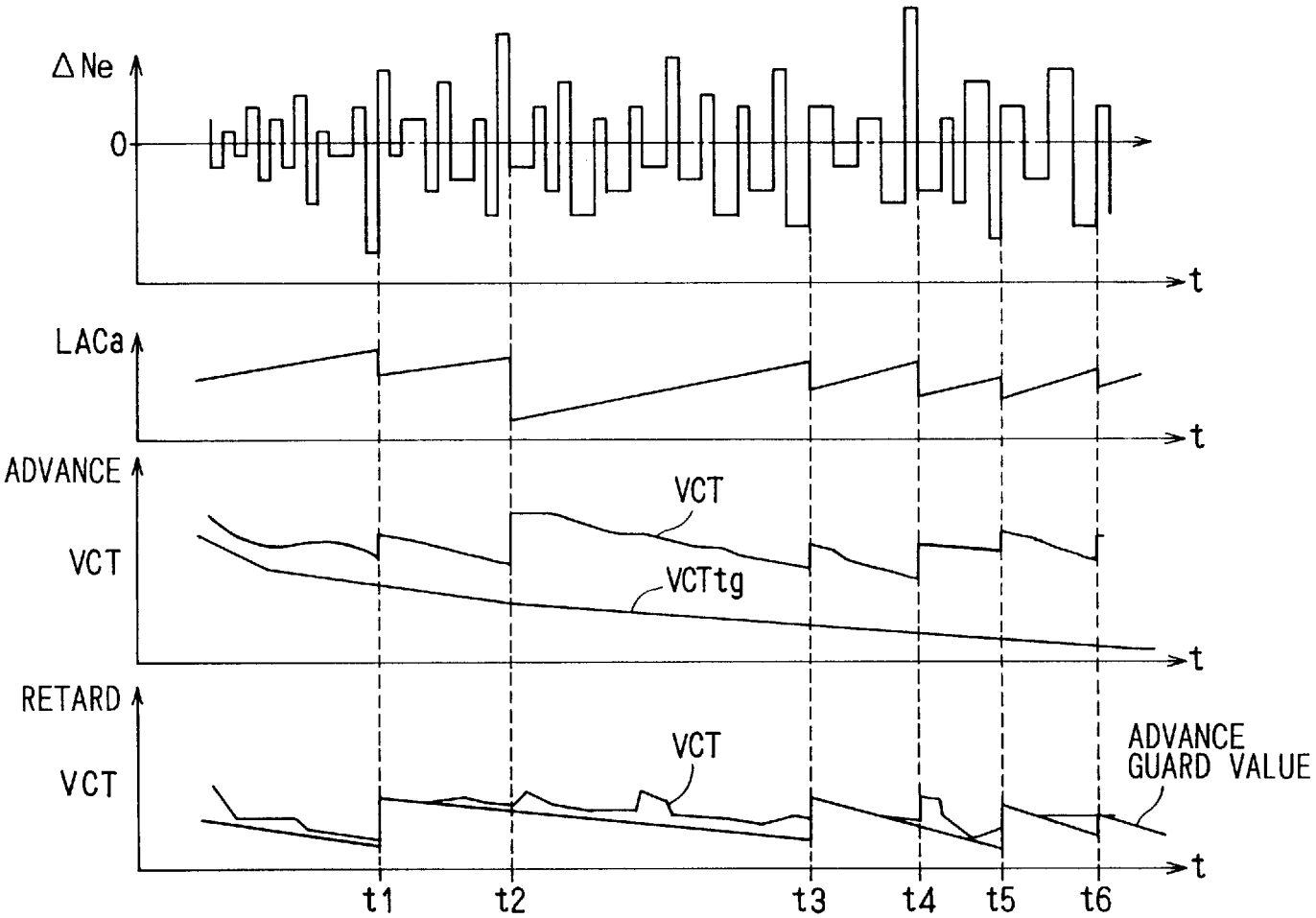
FIGS. 14A, 14B, 14C and 14D are time charts showing the operation of the third embodiment of the invention.

FIG. 14A shows the fluctuation amount ΔNe of the engine speed Ne as a value corresponding to roughness. FIG. 14B shows the final correction value LACa. As the final correction value LACa, until the fluctuation amount of the engine speed Ne becomes large, the correction value COEFa is set, and the correction value which advances the valve timing by a predetermined value is set. For example, at time points t1 to t6, the value corresponding to roughness becomes large, as the final correction value LACa, the roughness correction value RAFa which largely advances the valve opening timing in accordance with the value corresponding to roughness is set. Based on the final correction value LACa, the target valve opening timing VCTtg is corrected as shown in FIG. 14C, thereby obtaining the corrected valve opening timing VCT. In the correction, when the value corresponding to roughness is small, the valve opening timing is gradually advanced. When the value corresponding to roughness becomes large, the valve opening timing is largely corrected to the retard side.

FIG. 14D shows a case where correction according to the value corresponding roughness is performed with respect to an advance-side guard of the valve opening timing VCT. When the value corresponding to roughness increases, the advance guard value of the ignition timing is largely retarded, so that the fluctuation amount of the engine speed Ne can be suppressed.

In the embodiment, hunting of the valve opening timing can be prevented. Specifically, only when the value corresponding to roughness becomes large, the valve opening timing is corrected to the direction that combustion becomes stable. Thus, the valve opening timing according to the operating conditions can be controlled while preventing deterioration in drivability.

The above-described control may be applied to the control of retarding the intake valve. When the intake valve opening timing is regarded, HC gas increases, so that combustion becomes unstable in a manner similar to the control on the advance side. The control is effective as a countermeasure against the unstable combustion.

Fourth Embodiment

Figure 15:
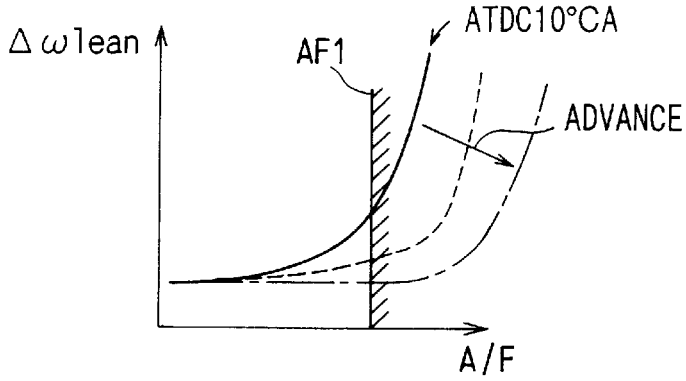
FIG. 15 is a graph showing the relation between the air-fuel ratio and roughness.

In the first embodiment, the engine speed fluctuation amount Δωlean is used to correct the lean correction value. In addition to the control, in the operating state at the time of a cold start, it is preferable to execute an ignition timing retarding control for a catalyst early warm-up. However, when the ignition timing is advanced in response to another request or the like from the ignition timing retarded state, there is the possibility that the following problems occur. When the ignition timing is advanced, combustion becomes stable as compared with combustion in a retarded state. Consequently, the engine speed fluctuation amount decreases, so that the air-fuel ratio becomes leaner than the target air-fuel ratio. FIG. 15 shows the relation between the air-fuel ratio and the engine fluctuation amount Δωlean. The straight line AF1 shows an air-fuel ratio which is on a slightly lean side with respect to the target air-fuel ratio. As the ignition timing advances, the engine speed fluctuation amount Δωlean decreases. Consequently, when the air-fuel ratio becomes leaner than the target air-fuel ratio, the correction value which is set on the basis of the engine speed fluctuation amount Δωlean is set so that the air-fuel ratio becomes leaner.

In the fourth embodiment, a control for solving such a problem is executed. In the embodiment, description of the same part as that in the first embodiment will not be repeated, and only a different part will be described. The flowchart shown in FIG. 16 relates computation of the fluctuation amount of the engine speed Ne. In the flowchart, the same steps as those in FIG. 6 of the first embodiment are designated by the same numbers.

Figure 17:
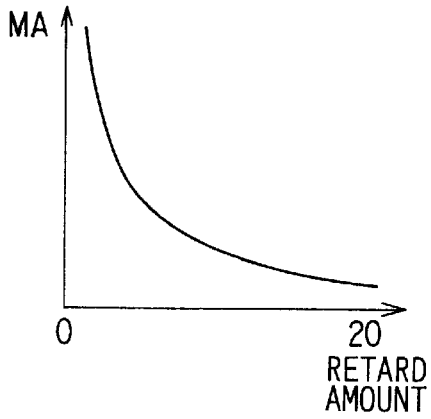
FIG. 17 is a graph showing a function for setting a correction value corresponding to an ignition timing according to the fourth embodiment of the invention.
Figure 16:
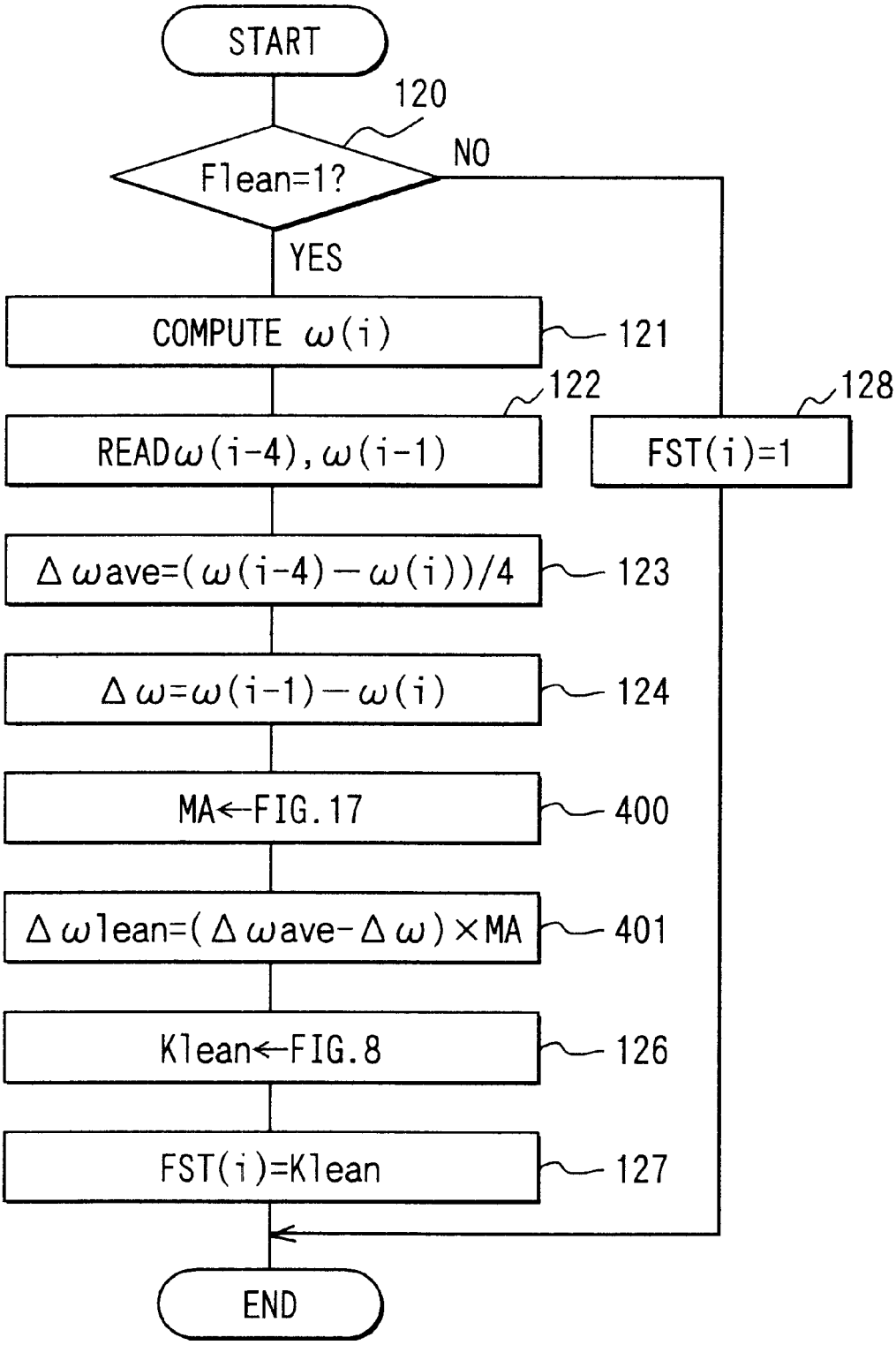
FIG. 16 is a time chart showing a roughness detecting process according to a fourth embodiment of the invention.

In step 400 in the flowchart of FIG. 16, from a map shown in FIG. 17, a correction value MA according to a retard amount of the ignition timing is computed. According to the map of FIG. 17, as the retard amount of the ignition timing increases, a smaller value (reference value 1) is set as the correction value MA.

In step 401, the angular velocity fluctuation amount Δωlean is computed on the basis of Δωave, Δω, and correction value MA.

In the embodiment, even when the ignition timing is advanced, the air-fuel ratio is prevented from becoming leaner than the target air-fuel ratio.

Figure 18A:
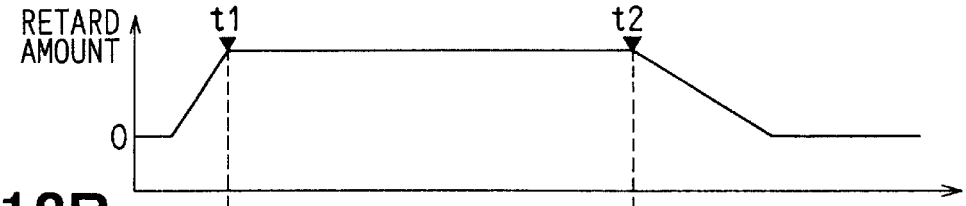
FIGS. 18A, 18B, 18C, 18D and 18E are time charts showing the operation of the fourth embodiment of the invention.
Figure 18B:
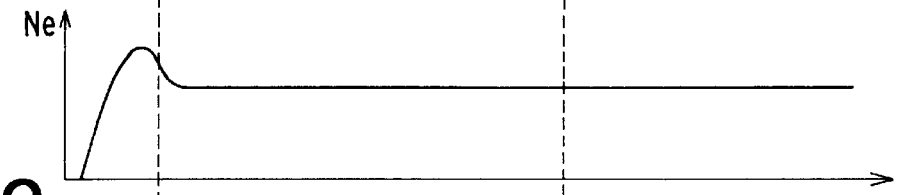
Figure 18C:
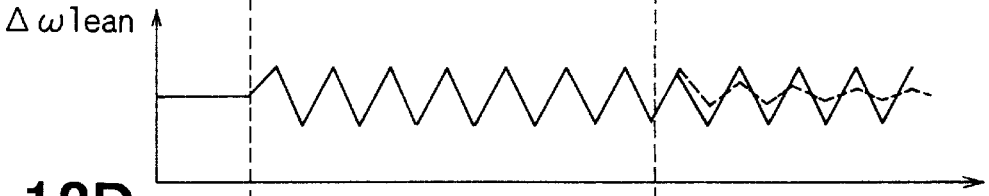

FIG. 18B shows the engine speed Ne. When the engine starts and the engine speed Ne exceeds a predetermined engine speed at t1, the retard amount of the ignition timing shown in FIG. 18A is set to the target ignition retard amount by the ignition timing retarding control. For example, when the catalyst early warm-up is finished at t2, the ignition timing is advanced to be thereby set to the normal ignition timing. As a result, the engine speed fluctuation amount Δωlean decreases as shown by the dotted line in FIG. 18C. In the embodiment, the engine speed fluctuation amount Δωlean becomes a fluctuation amount shown by the solid line by the correction value MA.

Figure 18D:
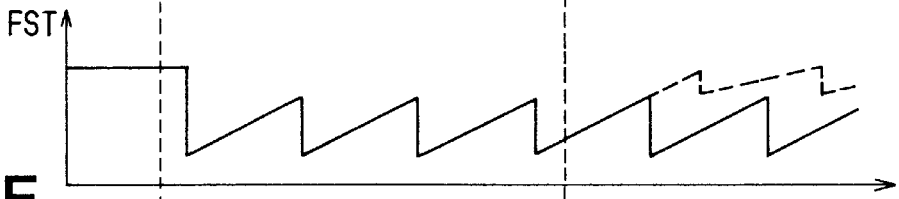
Figure 18E:
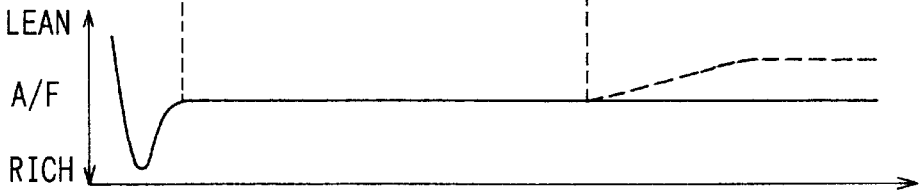

A correction value FST(n) for preventing deterioration in drivability is prevented from being set to the lean side as shown by a broken line of FIG. 18D. The correction value FST(n) is set so as to maintain the target air-fuel ratio as shown by the solid line. As a result, as shown in FIG. 18E, the air-fuel ratio is prevented from becoming leaner than the target air-fuel ratio as shown by the broken line. The air-fuel ratio is controlled to the target air-fuel ratio with high precision as shown by the solid line.

Figure 19:
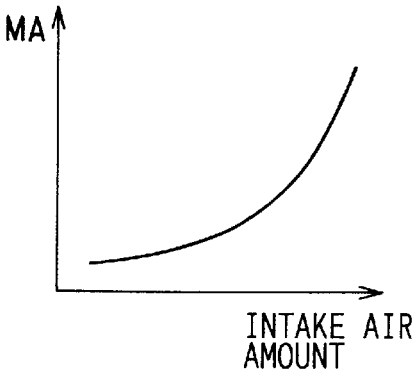
FIG. 19 is a graph showing a function for setting a correction value corresponding to an intake air amount.
Figure 20:
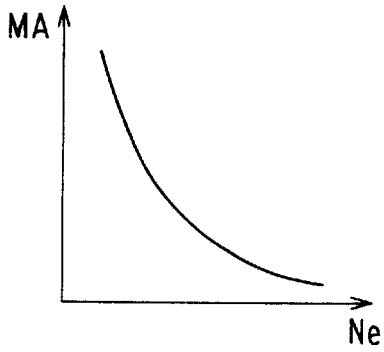
FIG. 20 is a graph showing a function for setting a correction value corresponding to engine speed.

In the embodiment, the correction value MA is set according to the ignition timing. However, the invention is not limited to the correction amount MA but any parameter which exerts an influence on the engine speed fluctuation amount Δωlean may be used. As parameters which exert an influence on the engine speed fluctuation amount Δωlean, an air amount Q, engine speed Ne, and the like can be mentioned. For example, in the case of setting the correction value MA in accordance with the air amount Q, it can be set from a map as shown in FIG. 19. According to the map, a correction value which increases as the air amount Q increases is set. In the case of setting the correction value MA in accordance with the engine speed Ne, it can be set from a map as shown in FIG. 20. According to the map, the correction value MA which decreases as the engine speed Ne increases may be set.

Fifth Embodiment

Figure 21:
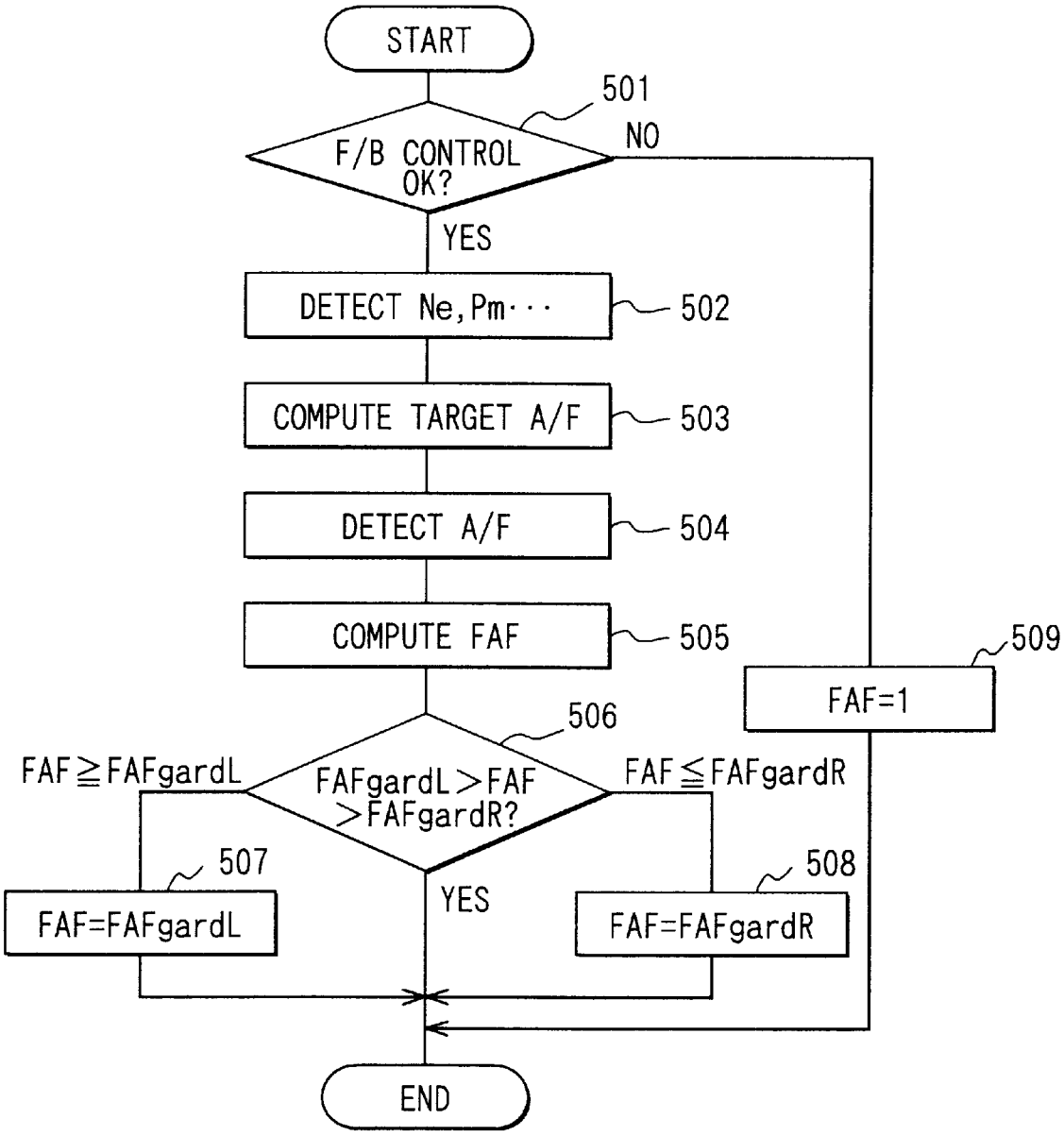
FIG. 21 is a flowchart showing an air-fuel ratio feedback control process according to a fifth embodiment of the invention.

A first embodiment will now be described. In the fifth embodiment as well, the configuration of FIG. 1 is employed. First, an air-fuel ratio feedback program will be briefly described by referring to the flowchart of FIG. 21. In step 501, whether feedback conditions are satisfied or not is determined. The feedback conditions are such that the A/F sensor 15 is in an active state and, as a transient operating state, an acceleration/deceleration operating state (fuel cut, fuel increasing correction, and the like) is not set. Only when all of the above conditions are satisfied as the conditions of executing the feedback control, the program advances to step 502. When the conditions are not satisfied, the program advances to step 509 where 1 is set as a feedback correction factor FAF, and the routine is finished.

On the other hand, in step 502, as operating conditions of the internal combustion engine, the engine speed Ne, intake pipe pressure Pm, engine cooling water temperature Tw, and the like are detected. In step 503, on the basis of the operating conditions, the target air fuel ratio is computed. Subsequently, in step 504, an actual air-fuel ratio in the exhaust pipe 3 is detected by the A/F sensor 15.

In step 505, an air-fuel ratio feedback correction factor FAF for controlling the air-fuel ratio on the basis of the deviation between the target air-fuel ratio and the actual air-fuel ratio is computed. In step 506, the feedback correction factor FAF is compared with guard values FAFgardL and FAFgardR.

When the feedback correction factor FAF lies in the guard area and satisfies the relation of FAFgardL>FAF>FAFgardR, the feedback correction factor FAF remains as the value which is set on the basis of the target air-fuel ratio and the actual air-fuel ratio, and the routine is finished.

On the other hand, if the feedback correction factor FAF is equal to or larger than the guard value FAFgardL which will be described hereinlater in step 506, the program advances to step 507 where FAFgardL is set as the feedback correction factor FAF, and the routine is finished. On the other hand, if the feedback correction factor FAF is equal to or smaller than the guard value FAFgardR in step 506, the program advances to step 508 where the guard value FAFgardR is set as the feedback correction factor FAF, and the routine is finished.

Figure 22:
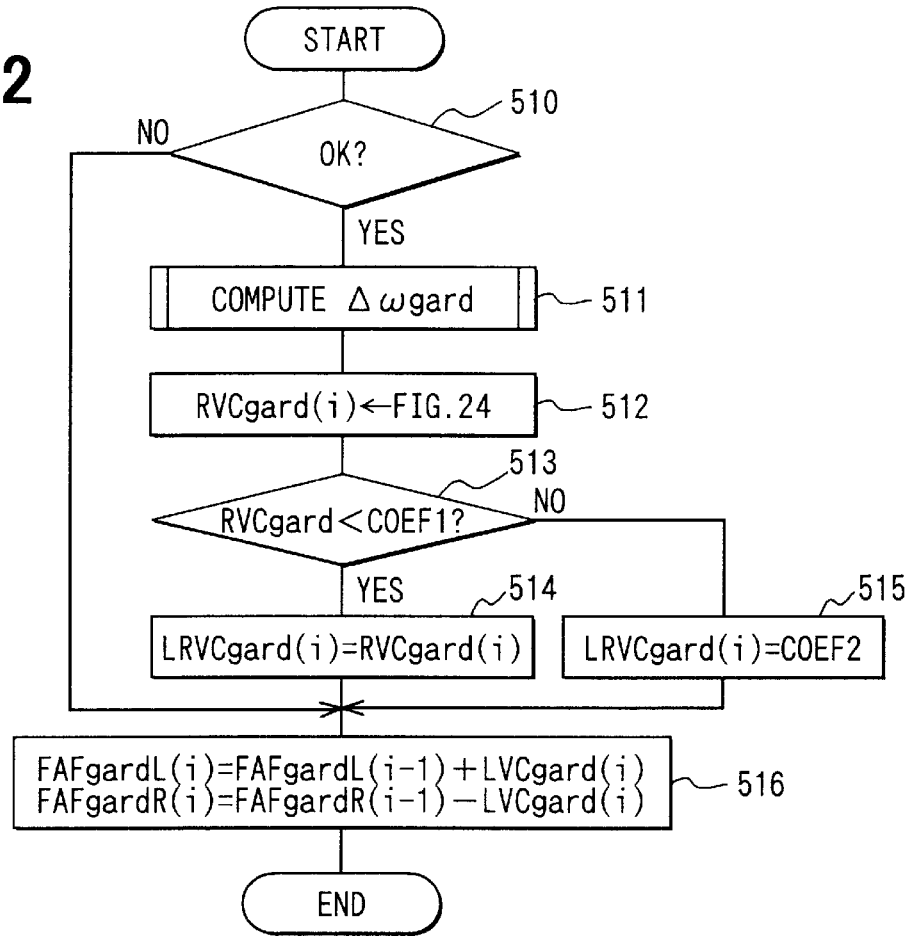
FIG. 22 is a flowchart showing a guard process according to the fifth embodiment of the invention.

The flowchart of FIG. 22 shows a feedback correction factor guard process. First, in step 510, whether execution conditions are satisfied or not is determined. The execution conditions are conditions on which the feedback control is executed and are such that the A/F sensor 15 is in an active state and a transient operating state is not an acceleration/deceleration operating condition (such as fuel cut or fuel increase correction). Only when all the above conditions are satisfied as the conditions of executing the feedback, the program advances to step 511. On the other hand, if even one of the conditions of executing the feedback control is not satisfied, the routine is finished.

When the execution conditions are satisfied and the program advances to step 511, on the basis of the engine speed Ne, the engine speed fluctuation amount (hereinbelow, called a detected roughness value) is obtained by computation. The computation is executed by a detected roughness value computing program shown in the flowchart of FIG. 23. The program is started, for example, every 30° CA of the rotation phase of the crankshaft of the not-shown engine, and the computation of the detected roughness value is executed. The processes of the program are the same as those in steps S121 to S125 in FIG. 6. In place of Δωlean in FIG. 6, Δωgard is obtained.

In step 512, a guard correction value RVCgard(i) for the guard value of the air-fuel ratio is computed on the basis of the detected roughness value Δωgard. The guard correction value RVCgard(i) is computed by using the map shown in FIG. 24. According to the map of FIG. 24, as the detected roughness value Δωgard increases, a smaller correction value RVCgard(i) is set.

In step 513, whether the correction value RVCgard(i) is smaller than a predetermined value COEF1 or not is determined. In the case where the correction value RVCgard(i) is determined to be smaller than the predetermined value COEF1, that is, when the detected roughness value Δωgard (i) indicates that the fluctuation amount of the engine speed is large, the program advances to step 514. In step 514, the guard correction value RVCgard(i) computed in step 512 is set as the final correction value LRVCgard(i). After that, the program advances to step 516.

On the other hand, in the case where the correction value RVCgard(i) is equal to or larger than the predetermined value COEF1, that is, when the detected roughness value Δωgard(i) indicates that the engine speed fluctuation amount is small, the program advances to step 515. In step 515, a predetermined value COEF2 for making the guard value gradually apart from the reference value is set as the final correction value LRVCgard(i), and the program advances to step 516. As a result, when the engine speed fluctuation is larger than the predetermined value Δωg, the guard value is corrected so as to get close to the reference value. When the engine speed fluctuation is smaller than Δωg, the guard value is corrected so as to be gradually apart from the reference value.

In step 516, the guard values are obtained. A guard value FAFgardL(i) on the lean side is obtained by adding the final correction value LRVCgard(i) to the guard value FAFgardL (i) of last time. Similarly, a guard value FAFgardR(i) on the rich side is obtained by adding the final correction value LVCgard(i) to the guard value FFgardR(i) of last time.

The operations in the case where the guard values FAFgardL(i) and FAFgardR(i) are used for the air-fuel ratio control when an output value of the A/F sensor 15 is erroneous will be described by using the time charts of FIGS. 25A to 25D. In the time charts, an example that a sub-feedback control of a rear O2 sensor is not performed will be described.

First, FIG. 25A shows an output value of the A/F sensor 15. The output value of the A/F sensor 15 is the same as the actual air-fuel ratio up to time t1 but is different from the actual air-fuel ratio in a range from time t1 to time t2 as shown by a broken line. After t2, the A/F output value is not shown. In the case where the output value of the A/F sensor 15 is erroneous as described above, the feedback correction factor FAF is obtained by a regular feedback control up to t1. For example, at the time of switching the output value of the A/F sensor 15 to the lean or rich side, an FAF value skipping control is performed. In the case where an output value of the A/F sensor 15 is a rich or lean output, an FAF value integral control is performed. In such a manner, the air-fuel ratio is controlled to the target air-fuel ratio such as the stoichiometric air-fuel ratio. At time t1 or later, when the output value of the A/F sensor 15 becomes largely rich, the feedback control decreases the FAF value to reduce the fuel injection amount so that the rich air-fuel ratio follows the target air-fuel ratio. By using fixed guard values FL and FR shown by broken lines in FIG. 25D, the FAF value reaches the guard value FL, and the air-fuel ratio largely changes to the lean side as shown by an alternate long and short dash line in FIG. 25A.

In the case where the output value of the A/F sensor 15 recovers to a normal value at time t2, a lean air-fuel ratio is output, so that the FAF value is largely skipped and controlled to a value which largely increases the fuel injection amount.

Figure 23:
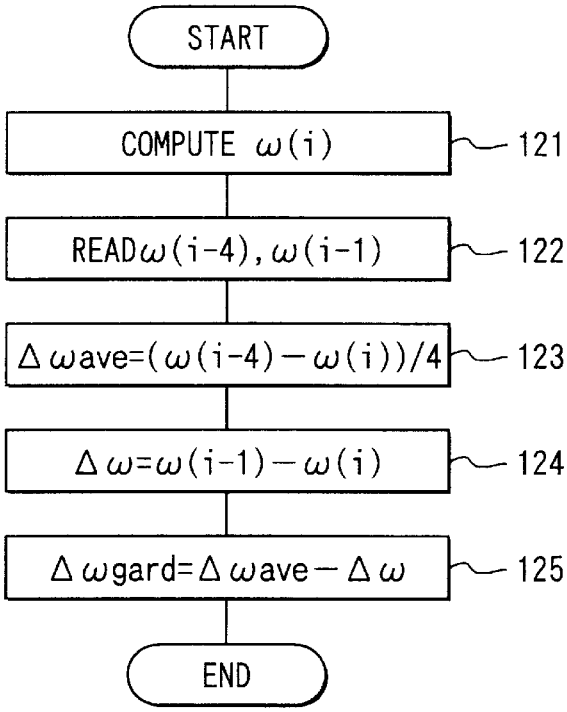
FIG. 23 is a flowchart showing a roughness detecting process according to the fifth embodiment of the invention.

In the embodiment, therefore, as shown in FIG. 25B, the detected roughness value Δωgard is obtained from a detected roughness value computing routine of FIG. 23. Based on the detected roughness value Δωgard, as shown in FIG. 25C, the final correction value RVCgard is set. The final correction value RVCgard is corrected so that the larger the detected roughness value Δωgard is, the guard value becomes small with respect to the reference value (for example, 1) of the feedback correction factor FAF value.

In other words, when the actual air-fuel ratio is largely deviated from the target air-fuel ratio and the FAF value therefore largely decreases the fuel injection amount, the actual air-fuel ratio becomes lean and the detected roughness value Δωgard increases. In the embodiment, however, the final correction value RVCgard is set in such a manner that when the detected roughness value Δωgard becomes large with respect to the reference value, the deviation between each of the guard values FAFgardL and FAFgardR and the reference value of the feedback correction factor FAF value decreases. When the detected roughness value Δωgard is small, each of the guard values FAFgardL and FAFgardR is set so as to be apart from the reference value of the feedback correction factor FAF value.

As described above, the guard value for the FAF value is corrected in accordance with the detected roughness value Δωgard, so that the guard value close to the reference value 1 of the FAF value is set as shown in FIG. 25D. As a result, even if the sensor signal becomes an abnormal value, the actual air fuel ratio is prevented from being largely apart from the target air fuel ratio as shown in FIG. 25A. Even in the case where the output value of the A/F sensor 15 is deviated largely to the lean side, a similar effect can be obtained.

It is also possible to set so that the deviation between each of the guard values FAFgardL and FAFgardR and the reference value 1 is reduced in the case where a sharp decrease and/or a sharp increase of the engine speed is/are detected.

Sixth Embodiment

Figure 26:
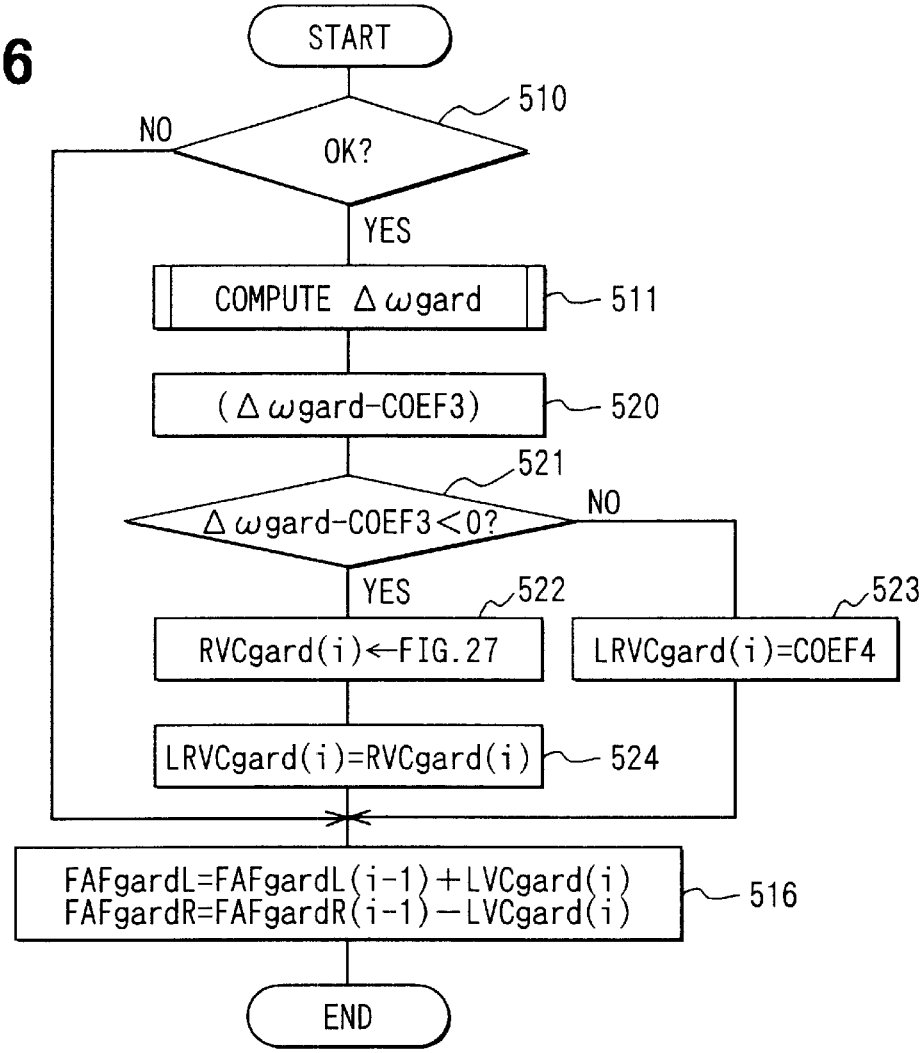
FIG. 26 is a flowchart showing a guard process according to a sixth embodiment of the invention.

In a sixth embodiment, the guard values FAFgardL and FAFgardR for the feedback correction factor FAF value are set by the following method. In the following, a guard value computing program shown by the flowchart of FIG. 26 will be described. The same reference numerals are designated to the same processing steps as those in the flowchart of FIG. 22, and only the different part will be described.

In step 520, a value obtained by subtracting the predetermined value COEF3 from the detected roughness value Δωgard is computed. When the engine speed Ne drops, a negative detected roughness value Δωgard is calculated. In the embodiment, in order to correct the guard values FAFgardL and FAFgardR with respect to the drop in the engine speed Ne, if a value obtained by subtracting the predetermined value COEF3 (negative value) from the detected roughness value Δωgard is a negative value in step 521, the program advances to step 522.

Figure 27:
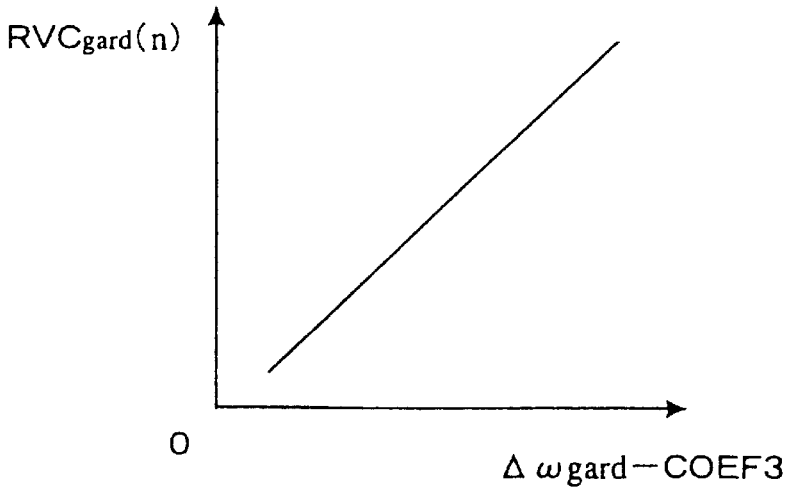
FIG. 27 is a graph showing a function for setting the correction value of the guard value according to the sixth embodiment of the invention.

In step 522, the guard correction value RVCgard(i) according to (Δωgard−COEF3) is computed by using the map of FIG. 27. According to the map, the larger the value (Δωgard−COEF3) is, the larger correction value RVCgard(i) is set. In step 524, the correction value RVCgard(i) is set as, the final correction value LRVCgard(i), and the program advances to step 516. On the other hand, when it is determined in step 521 that the value (Δωgard−COEF3) is a positive value, the guard value is gradually increased in step 523. Specifically, the predetermined factor COEF4 is set as the final correction value LRVCgard(i) so as to increase the deviation from the reference value (for example, 1) of the FAF value, and the program advances to step 516.

In the embodiment as well, even when the output value of the A/F sensor 15 is largely deviated from the actual air-fuel ratio, the guard values FAFgardL and FAFgardR are corrected on the basis of the detected roughness value Δωgard. Thus, the feedback correction factor FAF value is suppressed from excessively correcting the fuel injection amount. Therefore, the actual air fuel ratio can be suppressed from being largely deviated from the target air-fuel ratio.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A controller for an internal combustion engine, comprising:

lean correcting means for setting a lean correction value for correcting a fuel injection amount by decreasing the fuel injection amount during an operation after a cold start of an internal combustion engine and controlling an air-fuel ratio of the internal combustion engine to be leaner than a stoichiometric air-fuel ratio;

engine speed fluctuation detecting means for detecting fluctuations in revolution speed of the internal combustion engine;

correction amount calculating means for calculating a correction value for correcting the air-fuel ratio to the rich side on the basis of the engine speed fluctuation detected by the engine speed fluctuation detecting means;

final correction value calculating means for calculating a final correction value of this time by selecting either a final correction value of last time or a correction value calculated by the correction amount calculating means as a correction value which suppresses the engine speed fluctuation more; and fuel injection amount correcting means for correcting the fuel injection amount on the basis of the lean correction value and the final correction value.

2. The controller for an internal combustion engine according to claim 1, further comprising:

engine speed detecting means for detecting revolution speed of the internal combustion engine; and reference engine speed setting means for setting a reference engine speed as a reference value for the engine speed, wherein the lean correcting means sets the lean correction value on the basis of the reference engine speed and a detected engine speed.

3. The controller for an internal combustion engine according to claim 1, wherein the engine speed fluctuation detecting means is means for obtaining an angular velocity in each of a plurality of cylinders and detecting an engine speed fluctuation on the basis of variations of the angular velocity.

4. A controller for an internal combustion engine, comprising:

engine speed fluctuation detecting means for detecting fluctuations in revolution speed of an internal combustion engine;

final correcting means for correcting a predetermined parameter used for controlling the internal combustion engine on the basis of a final correction value; and control means for controlling the internal combustion engine on the basis of the predetermined parameter corrected by the final correcting means, wherein correction value setting means for setting a correction value for correcting the predetermined parameter on the basis of an engine speed fluctuation detected by the engine speed fluctuation detecting means is provided, and the final correcting means selects either a correction value set by the correction value setting means or a final correction value of last time set by the final correcting means, which suppresses the engine speed fluctuation more, and sets a final correction value.

5. The controller for an internal combustion engine according to claim 4, further comprising target ignition timing setting means for setting a target ignition timing in accordance with operating conditions of the internal combustion engine, wherein the predetermined parameter is the target ignition timing.

6. The controller for an internal combustion engine according to claim 4, further comprising a variable valve mechanism for changing a timing of opening an intake valve and/or an exhaust valve of the internal combustion engine, wherein the predetermined parameter is a target timing of opening the intake valve and/or exhaust valve of the variable valve mechanism.

7. A controller for an internal combustion engine, comprising:

control means using a parameter which exerts an influence on a revolution speed fluctuation amount of an internal combustion engine;

basic fuel injection amount setting means for setting a basic fuel injection amount for carrying out combustion at a relatively lean air-fuel ratio;

engine speed fluctuation amount detecting means for detecting a revolution speed fluctuation amount of the internal combustion engine; and roughness correcting means for correcting the basic fuel injection amount which is set by the basic fuel injection amount setting means on the basis of the revolution speed fluctuation amount of the internal combustion engine detected by the engine speed fluctuation amount detecting means, wherein correcting means for correcting a correction amount in the roughness correcting means on the basis of the value of the parameter is provided.

8. The controller for an internal combustion engine according to claim 7, wherein the control means comprises at least one of:

ignition timing control means for retarding an ignition timing for a catalyst early warm-up at the time of a cold start operation of the internal combustion engine;

engine speed detecting means for detecting a revolution speed of the internal combustion engine; and intake air amount detecting means for detecting an intake air amount, and a parameter exerting an influence on the engine speed fluctuation amount is at least one of the ignition timing, the engine speed, and the intake air amount.

9. A controller for an internal combustion engine having control means for computing a feedback correction factor for feedback-controlling a fuel injection amount on the basis of an air-fuel ratio sensor output value and a target air-fuel ratio and controlling a fuel injection amount, comprising:

engine speed fluctuation detecting means for detecting fluctuations in revolution speed of an internal combustion engine; and guard value setting means for setting a guard value for regulating the feedback correction factor on the basis of fluctuations in revolution speed of the internal combustion engine detected by the engine speed fluctuation detecting means.

10. The controller for an internal combustion engine according to claim 9, wherein the guard value setting means sets a lean-side guard value and/or a rich-side guard value.

11. The controller for an internal combustion engine according to claim 10, wherein the guard value setting means sets the rich-side guard value and/or the lean-side guard value so that a deviation from a reference value of the feedback correction factor is reduced when the engine speed fluctuation exceeds a predetermined value.

12. The controller for an internal combustion engine according to claim 11, wherein when the engine speed fluctuation is smaller than the predetermined value, the guard value setting means sets the rich-side guard value and/or the lean-side guard value so that a deviation from a reference value of the feedback correction factor gradually increases.

* * * * *